US007619602B2

(12) United States Patent
Shin

(10) Patent No.: US 7,619,602 B2
(45) **Date of Patent: *Nov. 17, 2009**

(54) DISPLAY DEVICE USING DEMULTIPLEXER AND DRIVING METHOD THEREOF

(75) Inventor: Dong-Yong Shin, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 634 days.

This patent is subject to a terminal disclaimer.

(21) Appl. No.: 10/992,327

(22) Filed: Nov. 17, 2004

(65) Prior Publication Data

US 2005/0116919 A1 Jun. 2, 2005

(30) Foreign Application Priority Data

Nov. 27, 2003 (KR) ..... 10-2003-0085078

(51) Int. Cl.
*G09G 3/36* (2006.01)

(52) U.S. Cl. ..... 345/98; 345/100; 345/103; 370/535

(58) Field of Classification Search ..... 370/535; 345/57, 76, 92, 94, 98, 100–104
See application file for complete search history.

(56) References Cited

U.S. PATENT DOCUMENTS 4,447,812 A 5/1984 Soneda et al.
5,426,447 A * 6/1995 Lee ..... 345/103
5,510,807 A * 4/1996 Lee et al. ..... 345/103
5,555,001 A * 9/1996 Lee et al. ..... 345/93
5,633,653 A 5/1997 Atherton
5,708,454 A * 1/1998 Katoh et al. ..... 345/100
5,892,493 A * 4/1999 Enami et al. ..... 345/94
6,097,362 A 8/2000 Kim
6,333,729 B1 12/2001 Ha (Continued)

FOREIGN PATENT DOCUMENTS

CN 1116454 A 2/1996

(Continued)

OTHER PUBLICATIONS

Patent Abstracts of Japan, Publication No. 2000-356978; Publication Date: Dec. 26, 2000; in the name of Yeo et al.

(Continued)

*Primary Examiner*—Ricky Ngo
*Assistant Examiner*—Phuongchau B Nguyen
(74) *Attorney, Agent, or Firm*—Christie, Parker & Hale, LLP

(57) ABSTRACT

Disclosed is a display device using a demultiplexer. The demultiplexer sequentially samples data currents that are time-divided and applied by a data driver, and holds them to a plurality of data lines. Since the demultiplexer is to sample the data currents corresponding to N data lines during a horizontal period when performing 1:N demultiplexing, the data current corresponding to one data line is to be sampled during a 1/N horizontal period. According to one embodiment, a signal line coupled between the demultiplexer and the data driver is precharged with particular voltage before sampling the data current. The precharge voltage is sufficient to allow current transmitted to the signal line to be substantially sampled within a a given sampling time after the precharge voltage is applied.

21 Claims, 14 Drawing Sheets

U.S. PATENT DOCUMENTS

| | | | | |
|---|---|---|---|---|
| 6,348,906 | B1 | 2/2002 | Dawson et al. | |
| 6,359,608 | B1 | 3/2002 | Lebrun et al. | |
| 6,559,836 | B1 | 5/2003 | Mori | |
| 6,667,580 | B2 * | 12/2003 | Kim et al. | 345/76 |
| 6,731,266 | B1 * | 5/2004 | Jung | 345/103 |
| 6,771,028 | B1 | 8/2004 | Winters | |
| 6,924,784 | B1 * | 8/2005 | Yeo et al. | 345/98 |
| 7,015,882 | B2 * | 3/2006 | Yumoto | 345/100 |
| 7,038,652 | B2 | 5/2006 | Kang et al. | |
| 7,256,756 | B2 * | 8/2007 | Abe | 345/76 |
| 7,324,079 | B2 * | 1/2008 | Tobita | 345/100 |
| 7,342,559 | B2 * | 3/2008 | Shin | 345/98 |
| 7,403,176 | B2 * | 7/2008 | Chung et al. | 345/76 |
| 7,468,718 | B2 | 12/2008 | Shin | |
| 7,505,017 | B1 | 3/2009 | Yeo et al. | |
| 2003/0107561 | A1 | 6/2003 | Uchino et al. | |
| 2003/0132907 | A1 | 7/2003 | Lee et al. | |
| 2003/0179164 | A1 | 9/2003 | Shin et al. | |
| 2004/0032382 | A1 | 2/2004 | Cok et al. | |
| 2004/0056852 | A1 | 3/2004 | Shih et al. | |
| 2004/0227749 | A1 | 11/2004 | Kimura | |
| 2005/0052890 | A1 * | 3/2005 | Morita | 365/87 |
| 2005/0117611 | A1 * | 6/2005 | Shin | 370/536 |

FOREIGN PATENT DOCUMENTS

| | | | |
|---|---|---|---|
| CN | 1301377 | A | 6/2001 |
| CN | 1417771 | A | 5/2003 |
| CN | 1432989 | A | 7/2003 |
| CN | 1447302 | A | 10/2003 |
| CN | 1488131 | | 4/2004 |
| GB | 2 384 102 | A | 7/2003 |
| JP | 02-306293 | | 12/1990 |
| JP | 06-118913 | | 4/1994 |
| JP | 2000-122607 | | 4/2000 |
| JP | 2000-356978 | | 12/2000 |
| JP | 2002-40961 | | 2/2002 |
| JP | 2002-351357 | | 12/2002 |
| JP | 2003-058108 | | 2/2003 |
| JP | 2003-76327 | | 3/2003 |
| JP | 2003-114645 | | 4/2003 |
| JP | 2003-157048 | | 5/2003 |
| JP | 2003-177722 | | 6/2003 |
| JP | 2003-195812 | | 7/2003 |
| JP | 2003-195815 | | 7/2003 |
| JP | 2003-330386 | | 11/2003 |
| JP | 2004-029528 | | 1/2004 |
| JP | 2004-29755 | | 1/2004 |
| JP | 2004-145224 | | 5/2004 |
| KR | 2003-0075946 | | 9/2003 |
| KR | 10-2005-0045129 | | 5/2005 |
| KR | 10-2005-0045131 | | 5/2005 |
| KR | 10-2005-0051309 | | 6/2005 |
| KR | 10-2005-0051310 | | 6/2005 |
| KR | 10-2005-0051312 | | 6/2005 |
| WO | WO 02/39420 | A1 | 5/2002 |
| WO | WO 03/038797 | | 5/2003 |

OTHER PUBLICATIONS

Patent Abstracts of Japan, Publication No. 2003-114645, dated Apr. 18, 2003, in the name of Toshiyuki Kasai.
Patent Abstracts of Japan, Publication No. 2003-195812, dated Jul. 9, 2003, in the name of Katsumi Abe.
Patent Abstracts of Japan, Publication No. 2003-195815, dated Jul. 9, 2003, in the name of Akira Yumoto.
Korean Patent Abstracts, Publication No. 1020050045129 A; Date of Publication: May 17, 2005; in the name of Dong Yong Shin.
Korean Patent Abstracts, Publication No. 1020050045131 A; Date of Publication: May 17, 2005; in the name of Dong Yong Shin.
Korean Patent Abstracts, Publication No. 1020050051309 A; Date of Publication: Jun. 1, 2005; in the name of Dong Yong Shin.
Korean Patent Abstracts, Publication No. 1020050051310 A; Date of Publication: Jun. 1, 2005; in name of Dong Yong Shin.
Korean Patent Abstracts, Publication No. 1020050051312 A; Date of Publication: Jun. 1, 2005; in the name of Dong Yong Shin.
SIPO Patent Gazette, dated Oct. 8, 2008, for Chinese application 200510073819.1, noting references listed in this IDS.
U.S. Office action dated Jan. 6, 2009, for related U.S. Appl. No. 10/990,659, indicating relevance of listed reference in this IDS.
Patent Abstracts of Japan, Publication No. 2000-122607, dated Apr. 28, 2000, in the name of Norio Ozawa.
Patent Abstracts of Japan, Publication No. 2003-076327, dated Mar. 13, 2003, in the name of Koichi Iguchi.
Patent Abstracts of Japan, Publication No. 2003-330386, dated Nov. 19, 2003, in the name of Hajime Akimoto et al.
Office action dated Jan. 9, 2008 for related U.S. Appl. No. 10/990,659, citing 5,426,447 and 6,359,608.
Patent abstract of Japan for publication No. 2002-040961, dated Feb. 8, 2002 in the name of Yoshiharu Hashimoto.
Patent Abstract of Japan, Publication No. 2004-029755, dated Jan. 29, 2004, in the name of Hiroshi Takahara.
Korean Patent Abstracts, Publication No. 1020030075946, dated Sep. 26, 2003, in the name of O Gyeong Kwon et al.
China Office action dated Jun. 8, 2007, for CN 200510070218.5, and English translation.
T. Kretz et al; "A 3.4-inch Reflective Colour Active Matrix Liquid Crystal Display without Polarisers"; SID 02 Digest, May 2002, pp. 798-801.
M. Ohta et al; "A Novel Current Programmed Pixel for Active Matrix OLED Displays"; SID 03 Digest, May 20, 2003, pp. 108-111.
European Search Report, dated Sep. 22, 2005, for Application No. 05103845.3-2205, in the name of Samsung SDI Co., Ltd.
European Search Report dated Apr. 2, 2008, for European application 05103845.3, indicating relevance of U.S. Patent 6,559,836 listed in this IDS.
U.S. Office action dated Aug. 12, 2008, for related U.S. Appl. No. 11/112,835, indicating relevance of U.S. references listed in this IDS (except 6,333,729, 6,559,836 and 2003/0132907).
U.S. Office action dated Sep. 30, 2008, for related U.S. Appl. No. 11/124,926, indicating relevance of listed U.S. and Japan references in this IDS.
U.S. Notice of Allowance dated Dec. 2, 2008, for related U.S. Appl. No. 10/997,486, noting listed reference in this IDS.
U.S. Office action dated Feb. 18, 2009, for related U.S. Appl. No. 11/124,926, noting listed references in this IDS.

* cited by examiner

DISPLAY DEVICE USING DEMULTIPLEXER AND DRIVING METHOD THEREOF

CROSS REFERENCE TO RELATED APPLICATION

This application claims priority to and the benefit of Korean Patent Application No. 10-2003-0085078 filed on Nov. 27, 2003 in the Korean Intellectual Property Office, the entire content of which is incorporated herein by reference.

BACKGROUND OF THE INVENTION (a) Field of the Invention

The present invention relates to a display device using a demultiplexer. More specifically, the present invention relates to power wiring of a display device using a demultiplexer.

(b) Description of the Related Art

A display device generally requires a scan driver for driving scan lines and a data driver for driving data lines. The data driver has as many output terminals as it has data lines to convert digital data signals into analog signals and apply them to all of the data lines. In general, the data driver is configured with a plurality of integrated circuits (ICs). The plurality of ICs are used to drive all of the data lines given that a single IC is limited in the number of output terminals it contains. Demultiplexers may be adopted, however, to reduce the number of data driver ICs.

For example, a 1:2 demultiplexer receives data signals that are time-divided and applied by the data driver through a signal line. The demultiplexer divides the data signals into two data groups and outputs them to two data lines. Therefore, usage of a 1:2 demultiplexer reduces the number of data driver ICs by half. The recent trend with liquid crystal displays (LCDs) and organic electroluminescent displays is to mount the ICs for the data driver on the panel. In this instance, there is a greater need to reduce the number of data driver ICs.

Under current technology, when the IC for the demultiplexer, the data driver, and the scan driver is manufactured to be directly mounted on the panel, power supply points, power supply lines, and power wiring are formed as shown in FIG. 1 to supply power to the pixels.

Referring to FIG. 1, a left scan driver 20 is provided on a display area 10 for applying select signals to select scan lines $SE_1$ to $SE_m$, and a right scan driver 30 is provided on the display area for applying signals for controlling light emission to emit scan lines $EM_1$ to $EM_m$. A demultiplexer unit 40 and a data driver 50 are also provided on the display area for applying data signals to data lines $D_1$ to $D_m$. In this instance, vertical lines 60 are formed for supplying power supply voltages to the respective pixels, and a power line 70 coupled to each vertical line 60 on the top of the substrate is formed in the horizontal direction. Power line 70 and an external power supply line 80 surrounding scan drivers 20, 30 are coupled through a power supply point 90.

In this instance, since the current flows through power line 70 and vertical line 60 when a power supply voltage is used in the pixels, a voltage drop (i.e., an IR drop) is generated in power line 70 and vertical line 60 because of parasitic resistance in power line 70 and vertical line 60. The further along power line 70 and vertical line 60 from power supply point 90, the greater the voltage drop that is generated, the generated voltage drop being the greatest near the center of power line 70 and near the bottom of vertical line 60.

In general, since the pixels have characteristic deviations of driving transistors, it is generally required to obtain a margin of the saturation area in the characteristic curve of the driving transistors. However, when a great voltage drop is generated, power consumption is increased due to a general need to enlarge the power supply voltage to obtain a sufficient margin of the saturation area. Also, when sample/hold circuits are used for 1:N demultiplexing in the demultiplexer, it is generally required to sample the data current which corresponds to a data line during a 1/N time of a particular horizontal period, shortening the sampling time, and hindering an appropriate sampling of the data current.

SUMMARY OF THE INVENTION

According to one embodiment, the present invention provides a display device using a demultiplexer for reducing a voltage drop.

According to another embodiment, the present invention provides a display device for performing sampling within a given time.

In accordance with an exemplary embodiment of the present invention, a signal line between a demultiplexer and a data driver is precharged with a voltage before the data is sampled in the demultiplexer.

According to one embodiment, the present invention is directed to a display device including: a display area including a plurality of data lines for transmitting data currents for displaying images, and a plurality of pixel circuits coupled to the data lines; a plurality of first signal lines; a data driver coupled to the first signal lines for time-dividing a first current corresponding to the data current and transmitting the time-divided first current to the first signal lines; a demultiplexer unit including a plurality of demultiplexers for respectively receiving the first current from the first signal lines and transmitting the data current to at least two data lines; and a precharge unit coupled between the demultiplexer unit and the data driver for transmitting a precharge voltage to the first signal lines before the data driver transmits the first current to the first signal lines.

The demultiplexer includes a plurality of sample/hold circuits coupled to the first signal lines. Sample/hold circuits of a first group of the plurality of sample/hold circuits concurrently hold current sampled during a previous horizontal period to at least two data lines, and sample/hold circuits of a second group sequentially sample the first current sequentially applied through the first signal lines during a particular horizontal period.

The sample/hold circuits include first and second sample/hold circuits having input terminals coupled to one of the first signal lines and output terminals coupled to a first data line of the at least two data lines. The sample/hold circuits also include third and fourth sample/hold circuits having input terminals coupled to one of the first signal lines and output terminals coupled to a second data line of the at least two data lines. The first and third sample/hold circuits form the first group of sample/hold circuits, and the second and fourth sample/hold circuits form the second group of sample/hold circuits.

The precharge voltage is a voltage allowing the first current transmitted to the first signal line to be substantially sampled within a given sampling time after the precharge voltage is applied.

According to one embodiment, the precharge voltage is a voltage between a first voltage corresponding to current with a first level gray scale and a second voltage corresponding to current with a second level gray scale when the first current applied to a first signal line is substantially sampled within a current sampling period after the first current with the first level or the second level gray scale is transmitted to the first signal line during a previous sampling period.

The sample/hold circuit includes a sampling switch turned on in response to a sampling signal, a holding switching turned on in response to a holding signal, and a data storage element for sampling the first current when the sampling switch is turned on and holding the sampled current when the holding switch is turned on. According to one embodiment, the sampling signal is sequentially applied to the sample/hold circuits.

The data storage element data storage element includes a transistor having a source coupled to a first power source and having a gate and a drain coupled to the first signal line in response to the sampling signal, and a capacitor coupled between the gate and the source of the transistor for storing a voltage corresponding to the current transmitted to the drain.

According to one embodiment, the precharge voltage is a voltage between a fourth voltage and a second voltage when the first voltage is closer to a voltage of the first power source than is the second voltage, the difference between a maximum value and a representative value in absolute values of threshold voltages of transistors included in the sample/hold circuits is a third voltage, and the fourth voltage is a voltage further from the voltage of the first power source by an amount of the third voltage than is the first voltage.

According to another embodiment, the precharge voltage is a voltage between a sixth voltage and the fourth voltage when the difference between the representative value and the maximum value in absolute values of the threshold voltages of the transistors included in the sample/hold circuits is a fifth voltage, and the sixth voltage is a voltage closer to the voltage of the first power by an amount of the fifth voltage that is the second voltage.

According to another embodiment, the precharge voltage is a voltage between the fourth voltage and the second voltage when the difference between the maximum value and the minimum value in the voltages of the first power source of the sample/hold circuits is the third voltage, the first voltage is closer to the voltage of the first power source than is the second voltage, and the fourth voltage is a voltage further from the voltage of the first power source by an amount of the third voltage than is the first voltage.

According to another embodiment, the precharge voltage is a voltage between an eighth voltage and a seventh voltage when the difference between the maximum value and the representative value in the absolute values of the threshold voltages of the transistors included in the sample/hold circuits is a fifth voltage, the seventh voltage is defined to be a voltage which is further from the voltage of the first power source by an amount of the fifth voltage than is the fourth voltage, and the eighth voltage is a voltage which is closer to the voltage of the first power by an amount of the sixth voltage than is the second voltage.

The data storage element data storage element includes a transistor and a capacitor coupled between a gate and a source of the transistor, the sampling switch includes a first switch coupled between a drain of the transistor and an input terminal, a second switch for diode-connecting the transistor when turned on, and a third switch coupled between the first power and the transistor, and the holding switch includes a fourth switch coupled between a second power and the transistor, and a fifth switch coupled between the transistor and an output terminal.

According to one embodiment, a same precharge voltage is applied to the plurality of sample/hold circuits.

According to another embodiment, different precharge voltages are applied to at least two of the plurality of sample/hold circuits when ranges of the first current applied to the at least two of the plurality of sample/hold circuits are different.

The display area further includes a plurality of second signal lines for supplying a power supply voltage to the pixel circuit; and the display device further includes a power line insulated from the first signal line and crossing the first signal line between the demultiplexer unit and the data driver, the power line transmitting the power supply voltage from the second signal line.

The pixel circuit includes a transistor to which the data current flows from the data line, a capacitor coupled between the source and the gate of the transistor and storing a voltage corresponding to the current flowing to the transistor, and a light emitting element for emitting light corresponding to the current flowing to the transistor according to the voltage stored in the capacitor.

According to one embodiment, the light emitting element uses electroluminescent emission of organic matter.

According to another embodiment, the present invention is directed to method for driving a display device including a plurality of data lines for transmitting data currents for displaying images, a plurality of pixel circuits coupled to the data lines and displaying the images according to the data currents, and a plurality of first signal lines associated with at least two of the plurality of data lines and sequentially transmitting currents corresponding to the data currents. The method includes: applying a first precharge current to the first signal line; applying a first current corresponding to a data current to be applied to a first of the at least two data lines, to the first signal line; applying a second precharge current to the first signal line; applying a second current corresponding to a data current to be applied to a second of the at least two data lines, to the first signal line; and applying the data currents corresponding to the first and second currents to the first and second data lines.

In still another embodiment, the present invention is directed to a display device that includes: a display area including first and second data lines extended in one direction and a plurality of pixel circuits coupled to the first and second data lines; a first signal line; a first sample/hold circuit coupled between the first signal line and the first data line for holding a first data current for displaying an image, to the first data line; a second sample/hold circuit coupled between the first signal line and the second data line for holding a second data current for displaying an image, to the second data line; a data driver coupled to the first signal line for sequentially transmitting first and second currents respectively corresponding to first and second data currents to the first signal line; and a precharge unit coupled to the first signal line for transmitting a first precharge voltage to the first signal line before the first current is applied to the first signal line, and transmitting a second precharge voltage to the first signal line before the second current is applied to the first signal line. The first and second sample/hold circuits respectively sample the first and second currents during a portion of one horizontal period, and hold the first and second currents during a subsequent horizontal period.

DETAILED DESCRIPTION

Figure 1:
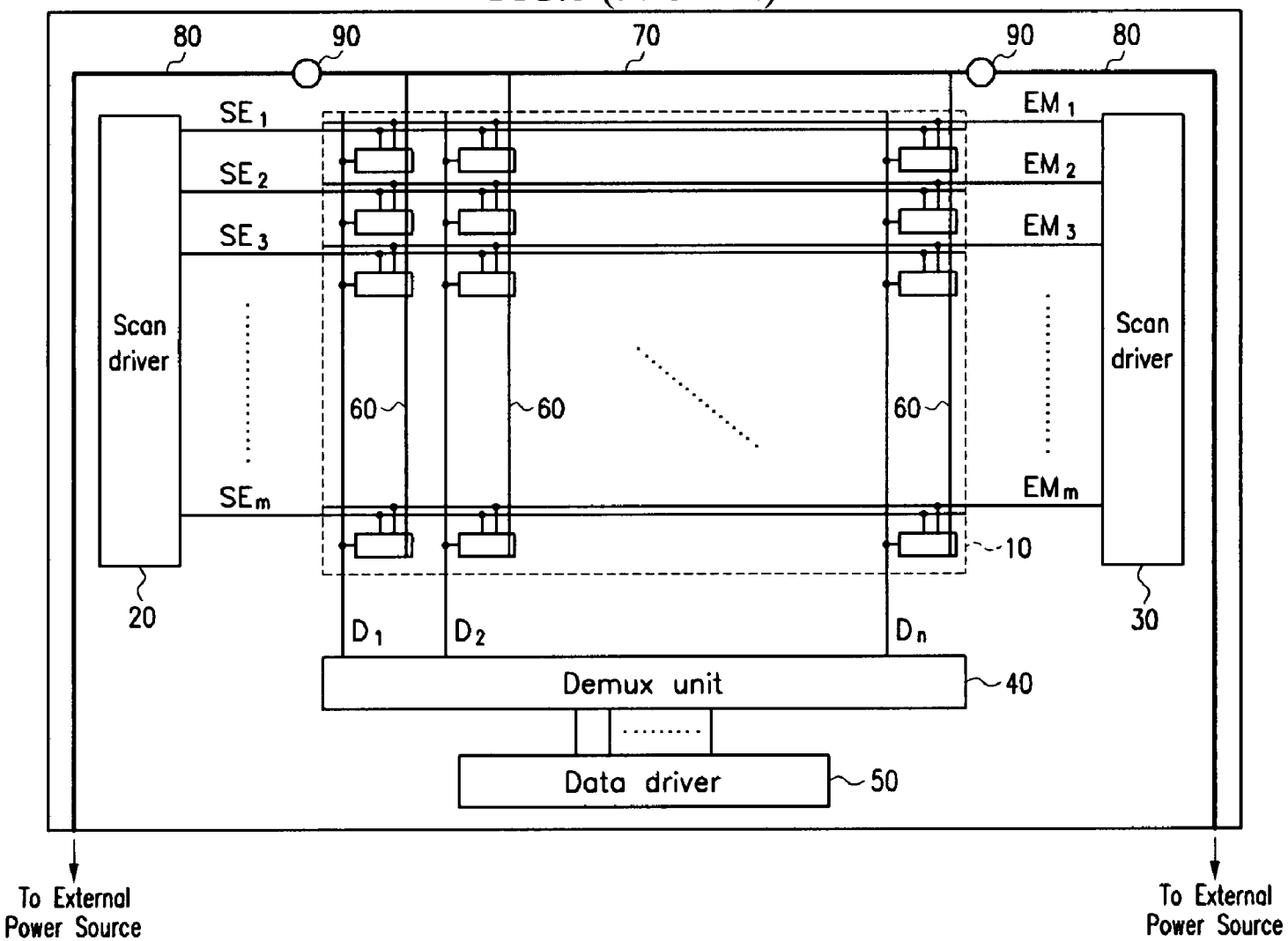
FIG.1 (Prior Art)
FIG. 1 shows a simplified view of a conventional display device using a demultiplexer.
Figure 2:
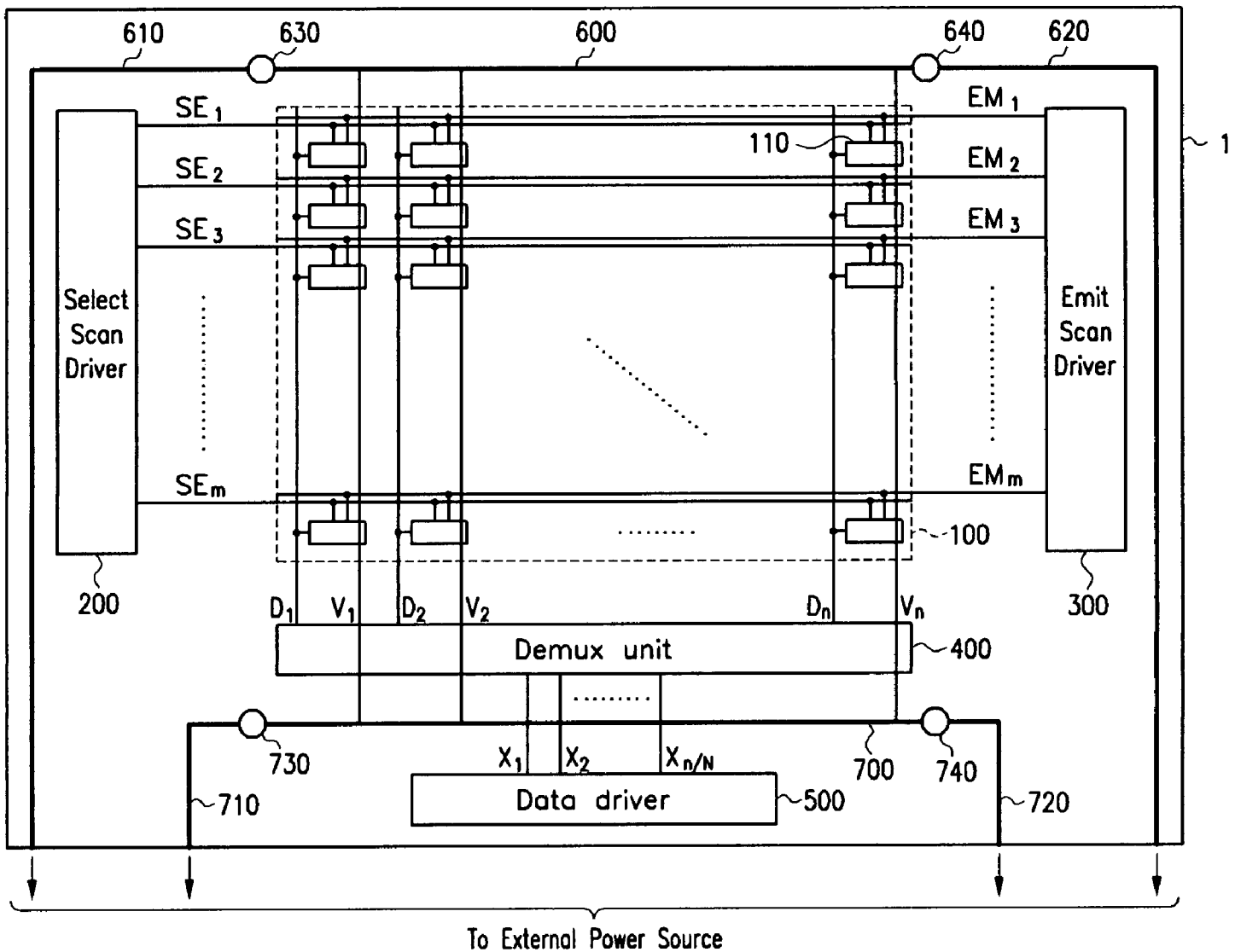
FIG. 2 shows a simplified view of a display device using a demultiplexer according to a first exemplary embodiment of the present invention.
Figure 3:
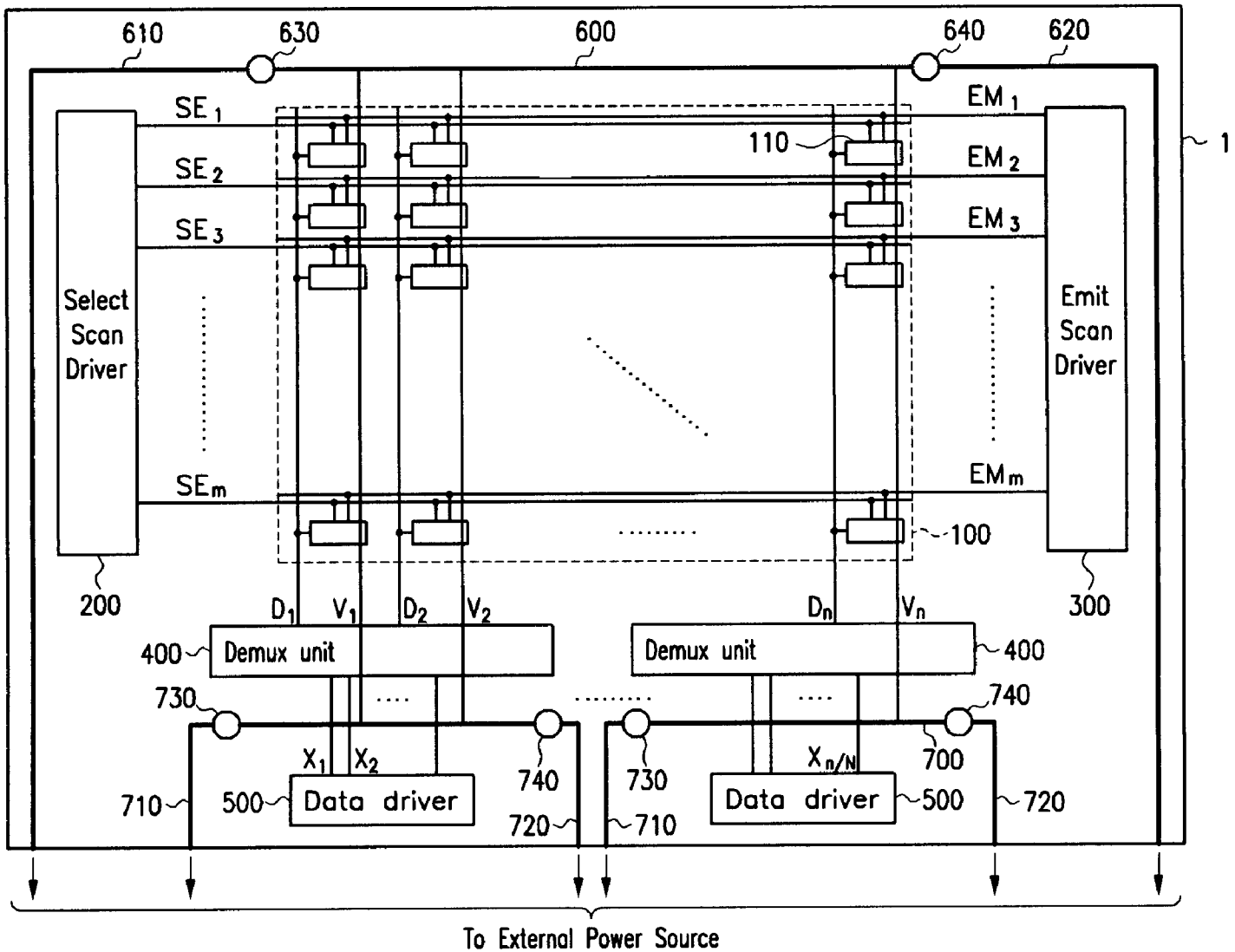
FIG. 3 shows the display device of FIG. 2 including a plurality of data drivers and demultiplexer units.

FIG. 2 shows a simplified view of a display device using a demultiplexer according to a first exemplary embodiment of the present invention. FIG. 3 shows a diagram of the display device of FIG. 2 including a plurality of data drivers and demultiplexers.

As shown in FIG. 2, the display device includes an insulation substrate 1 divided into a display area 100 which is visible to a user of the display device as a screen, and an outer surrounding area. A select scan driver 200, an emit scan driver 300, a demultiplexer unit 400, and a data driver 500 are formed on the surrounding area. According to one embodiment, data driver 500 may be formed not on the surrounding area of insulation substrate 1 but at a separate position and be coupled to insulation substrate 1, which is different from the illustration of FIG. 2.

Display area 100 includes a plurality of data lines $D_1$ to $D_n$, a plurality of select scan lines $SE_1$ to $SE_m$, a plurality of emit scan lines $EM_1$ to $EM_m$, and a plurality of pixel circuits 110. According to one embodiment, select and emit scan lines $SE_1$ to $SE_m$ and $EM_1$ to $EM_m$ are formed on insulation substrate 1, and gate electrodes (not illustrated) are coupled to the respective scan lines $SE_1$ to $SE_m$ and $EM_1$ to $EM_m$ which are covered with an insulation film (not illustrated). A semiconductor layer (not illustrated) made of silicon, such as, for example, amorphous silicon or polycrystalline silicon, is formed on the bottom of the gate electrode with an insulation layer therebetween. Data lines $D_1$ to $D_n$ are formed on the insulation film which covers scan lines $SE_1$ to $SE_m$ and $EM_1$ to $EM_m$, and source and drain electrodes are coupled to the respective data lines $D_1$ to $D_n$. The gate electrode, the source electrode, and the drain electrode configure three terminals of a thin-film transistor (TFT), and a semiconductor layer provided between the source electrode and the drain electrode is a channel layer of the transistor.

Referring to FIG. 2, data lines $D_1$ to $D_n$ extend in the vertical direction and transmit data currents for displaying images to pixel circuits 110. Select scan lines $SE_1$ to $SE_m$ and emit scan lines $EM_1$ to $EM_m$ extend in the horizontal direction and transmit select signals and emit signals to pixel circuits 110, respectively. Two adjacent data lines and two adjacent select scan lines define a pixel area where pixel circuit 110 is formed.

According to one embodiment, select scan driver 200 sequentially applies select signals to select scan lines $SE_1$ to $SE_m$, and emit scan driver 300 sequentially applies emit signals to emit scan lines $EM_1$ to $EM_m$. Data driver 500 time-divides and applies the data signals to demultiplexer unit 400, and demultiplexer unit 400 applies the time-divided data signals to data lines $D_1$ to $D_n$. When demultiplexer unit 400 performs 1:N demultiplexing, the number of signal lines $X_1$ to $X_{n/N}$ for transmitting the data signals to demultiplexer unit 400 from data driver 500 is n/N. That is, signal line $X_1$ transmits the time-divided and applied data signals to N data lines $D_1$ to $D_N$.

In this instance, select and emit scan drivers 200, 300, demultiplexer unit 400, and data driver 500 are mounted in an IC format on insulation substrate 1, and are coupled to scan lines $SE_1$ to $SE_m$ and $EM_1$ to $EM_m$, to signal lines $X_1$ to $X_{n/N}$, and to data lines $D_1$ to $D_n$ formed on insulation substrate 1. In addition, select and emit scan drivers 200, 300, demultiplexer unit 400, and/or data driver 500 may be formed on the same layer as the layers on which scan lines $SE_1$ to $SE_m$ and $EM_1$ to $EM_m$, signal lines $X_1$ to $X_{n/N}$, and data lines $D_1$ to $D_n$, and transistors of the pixel circuits are formed on insulation substrate 1. Further, data driver 500 may be mounted as a chip on a tape carrier package (TCP), a flexible printed circuit (FPC), or a tape automatic bonding (TAB) coupled to demultiplex unit 400.

Referring again to FIG. 2, a plurality of vertical lines $V_1$ to $V_n$ transmit a power supply voltage to pixel circuits 110 on display area 100. Vertical lines $V_1$ to $V_n$ may be formed on the same layer as that of data lines $D_1$ to $D_n$ without being superimposed on scan lines $SE_1$ to $SE_m$ and $EM_1$ to $EM_m$.

Power line 600 formed in the horizontal direction on the top of insulation substrate 1 is coupled to first ends of vertical lines $V_1$ to $V_n$. Power line 700 formed in the horizontal direction passes between demultiplexer unit 400 and data driver 500. Vertical lines $V_1$ to $V_n$ extend to pass through demultiplexer unit 400 and couple second ends of vertical lines $V_1$ to $V_n$ to power line 700. In this instance, power line 700 is formed on a layer different from that of signal lines $X_1$ to $X_{n/N}$ so that power line 700 may not be superimposed on signal lines $X_1$ to $X_{n/N}$.

Power supply lines 610, 620 are formed on insulation substrate 1 and coupled to power line 600 of display area 100 through first power supply points 630, 640. In a similar manner, power supply lines 710, 720 are formed on insulation substrate 1 and coupled to power line 700 of display area 100 through power supply points 730, 740. Power supply lines 610, 620 extend from power supply points 630, 640 and overhang scan drivers 200, 300 in the horizontal direction, and further extend in the vertical direction so that power supply lines 610, 620 may not be superimposed on scan lines $SE_1$ to $SE_m$ and $EM_1$ to $EM_m$, on data lines $D_1$ to $D_n$, and on signal lines $X_1$ to $X_{n/N}$. In a like manner, power supply lines 710, 720 extend in the vertical direction from power supply points 730, 740 so that power supply lines 710, 720 may not be superimposed on scan lines $SE_1$ to $SE_m$ and $EM_1$ to $EM_m$, on data lines $D_1$ to $D_n$, and on signal lines $X_1$ to $X_{n/N}$.

In this instance, first ends of power supply lines 610, 620, 710, 720 extended in the vertical direction are coupled to a pad (not illustrated), and further coupled to an external circuit board through the pad.

According to one embodiment, the widths of power lines 600, 700 and power supply lines 610, 620, 710, 720 are larger than those of vertical lines $V_1$ to $V_n$ since they transmit the current or the voltage to vertical lines $V_1$ to $V_n$.

Accordingly, four power supply points 630, 640, 730, 740 are formed on insulation substrate 1 to help solve the voltage drop generated on the bottom of vertical lines $V_1$ to $V_n$.

When a plurality of demultiplexer units 400*a*, 400*b* and data drivers 500*a*, 500*b* are formed as shown in FIG. 3, power supply lines 710*a*,710*b*, 720*a*, 720*b* are additionally arranged between the two data drivers 500*a*, 500*b* to increase the number of power supply points 630, 640, 730*a*, 730*b*, 740*a*, 740*b*.

Referring to FIGS. 4 to 8, a display device with a demultiplexer unit including sample/hold circuits will be described. For ease of description, the demultiplexer unit is described to perform 1:2 demultiplexing, and first signal line $X_1$ and data lines $D_1$ and $D_2$ corresponding to signal line $X_1$ are exemplified.

Figure 4:
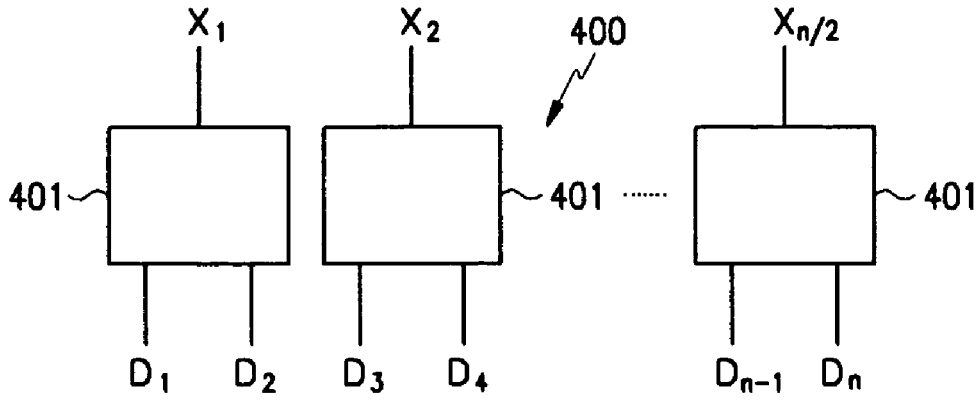
FIG. 4 shows a demultiplexer unit according to an exemplary embodiment of the present invention.
Figure 5:
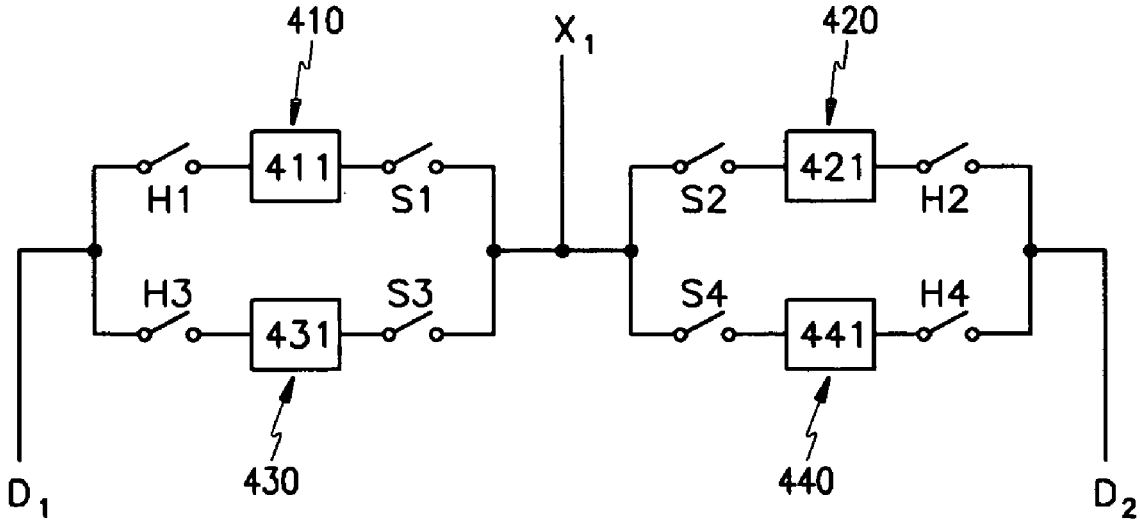
FIG. 5 shows a demultiplexer including sample/hold circuits.

As shown in FIG. 4, demultiplexer unit 400 includes a plurality of demultiplexers 401. Referring to FIGS. 4 and 5, demultiplexer 401 includes four sample/hold circuits 410, 420, 430, 440. The sample/hold circuits 410, 420, 430, 440 respectively include sampling switches S1, S2, S3, S4, data storage units 411, 421, 431, 441, and holding switches H1, H2, H3, H4. First terminals of sampling switches S1, S2, S3, S4 of sample/hold circuits 410, 420, 430, 440 are respectively coupled to data storage units 411, 421, 431, 441, and first terminals of holding switches H1, H2, H3, H4 are respectively coupled to data storage units 411, 421, 431, 441. Second terminals of sampling switches S1, S2, S3, S4 of sample/hold circuits 410, 420, 430, 440 are coupled in common to signal line $X_1$. Second terminals of holding switches H1, H3 of sample/hold circuits 410, 430 are coupled in common to data line $D_1$, and second terminals of holding switches H2, H4 of sample/hold circuits 420, 440 are coupled in common to data line $D_2$. Second terminals of sampling switches S1, S2, S3, S4 coupled to signal line $X_1$ will hereinafter be referred to as input terminals, and second terminals of holding switches H1, H2, H3, H4 coupled to data lines $D_1$ and $D_2$ will be hereinafter referred to as output terminals.

When sampling switches S1, S2, S3, S4 are turned on, sample/hold circuits 410, 420, 430, 440 respectively sample the currents transmitted through sampling switches S1, S2, S3, S4 and store them in data storage units 411, 421, 431, 441 in a voltage format. When holding switches H1, H2, H3, H4 are turned on, sample/hold circuits 410, 420, 430, 440 respectively hold the currents corresponding to the voltages stored in data storage units 411, 421, 431, 441 through holding switches H1, H2, H3, H4.

Referring to FIG. 5, sample/hold circuits 410, 430 coupled between signal line $X_1$ and data line $D_1$ form a single sample/hold circuit unit, and sample/hold circuits 410, 430 alternately perform sampling and holding. In a like manner, sample/hold circuits 420, 440 coupled between signal line $X_1$ and data line $D_2$ form a single sample/hold circuit unit, and sample/hold circuits 420, 440 alternately perform sampling and holding.

According to one embodiment of the invention, a sampling function of the sample/hold circuit includes recording an input current in a data storage element in voltage format, a standby function includes maintaining the data recorded in the data storage element, and a holding function includes outputting a current corresponding to the data recorded in the data storage element.

Referring to FIGS. 6 and 7A to 7D, an operation of the demultiplexer shown in FIG. 5 will be described.

Figure 6:
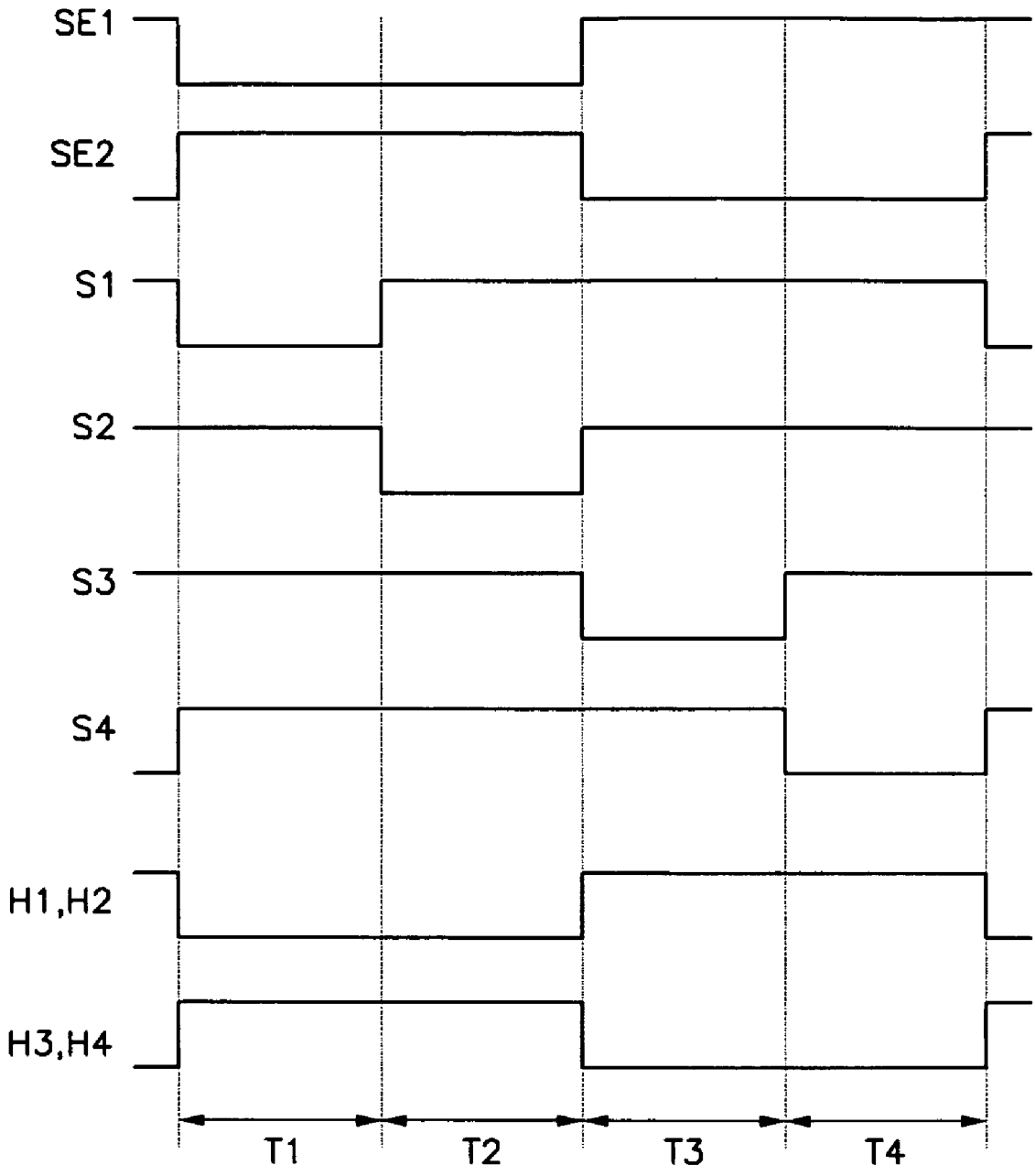
FIG. 6 shows a driving timing diagram of switches in the demultiplexer of FIG. 5.

FIG. 6 shows a driving timing diagram of switches in the demultiplexer of FIG. 5, and FIGS. 7A to 7D show an operation of the demultiplexer of FIG. 5 according to the timing diagram of FIG. 6. According to this timing diagram, sampling switches S1, S2, S3, S4 are turned on when a control signal level is low, and holding switches H1, H2, H3, H4 are turned on when the control signal level is high.

Figure 7A:
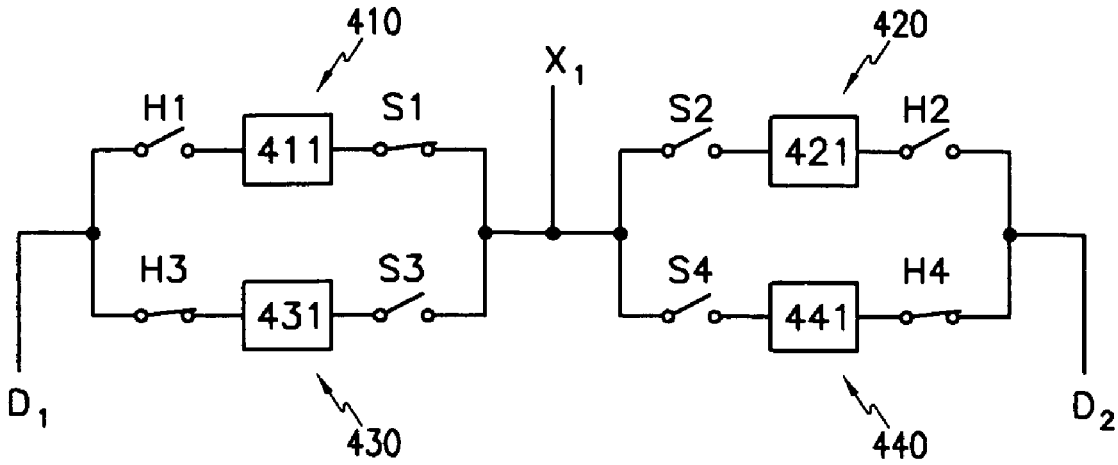
FIGS. 7A to 7D show an operation of the demultiplexer of FIG. 5 according to the timing diagram of FIG. 6.

Referring to FIGS. 6 and 7A, sampling switch S1 and holding switches H3, H4 are turned on in response to a control signal at time period T1. When sampling switch S1 is turned on, sample/hold circuit 410 samples the data current applied through signal line $X_1$ into storage element 411. When holding switches H3, H4 are turned on, sample/hold circuits 430, 440 hold the currents corresponding to the data stored in storage elements 431, 441 to data lines $D_1$, $D_2$. Sample/hold circuit 420 with the turned-off sampling switch S2 and holding switch H2 stand by.

Figure 7B:
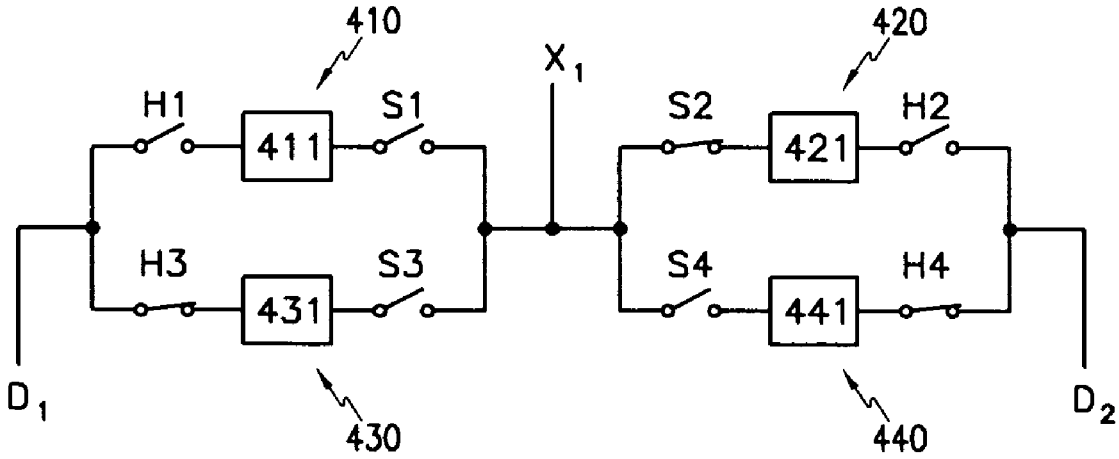

Referring to FIGS. 6 and 7B, sampling switch S1 is turned off and sampling switch S2 is turned on in response to a control signal while holding switches H3, H4 are turned on at time period T2. Since holding switches H3, H4 are turned on, the currents corresponding to the data stored in storage elements 431, 441 are consecutively held to data lines $D_1$, $D_2$. When sampling switch S2 is turned on, sample/hold circuit 420 samples the data current applied through the signal line $X_1$ into storage element 421.

Figure 7C:
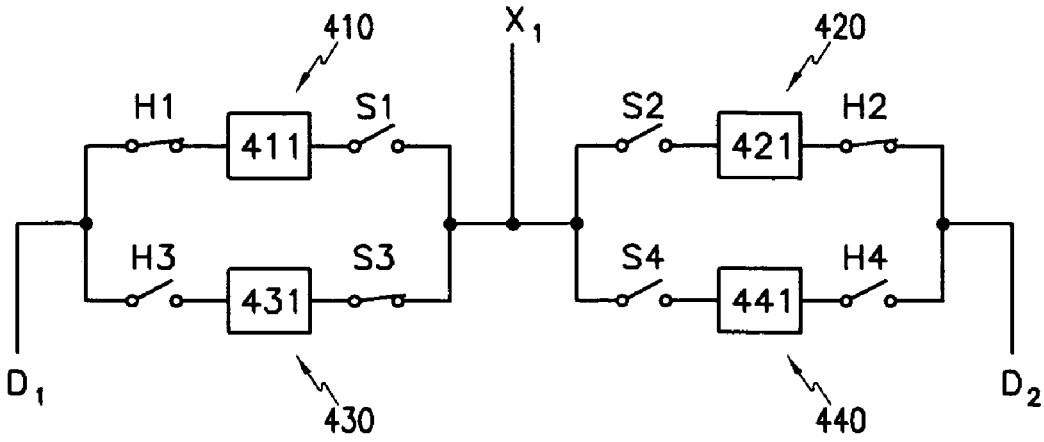

Referring to FIGS. 6 and 7C, sampling switch S2 and holding switches H3, H4 are turned off and sampling switch S3 and holding switches H1, H2 are turned on in response to a control signal at time period T3. When sampling switch S3 is turned on, sample/hold circuit 430 samples data current applied through signal line $X_1$ into storage element 431. When holding switches H1, H2 are turned on, sample/hold circuits 410, 420 respectively hold the currents corresponding to the data stored in storage elements 411, 421 to data lines $D_1$, $D_2$.

Figure 7D:
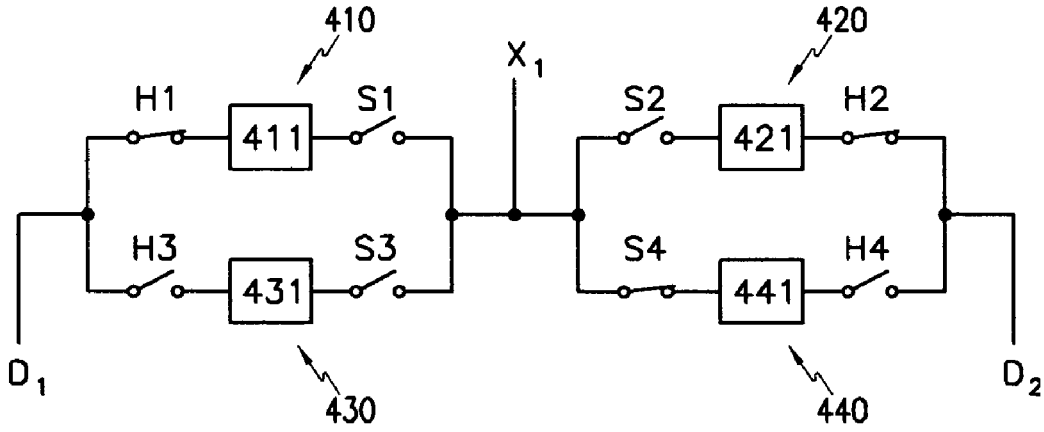

Referring to FIGS. 6 and 7D, sampling switch S3 is turned off and sampling switch S4 is turned on in response to a control signal while holding switches H1, H2 are turned on at time period T4. Since holding switches H1, H2 are turned on, the currents corresponding to the data stored in storage elements 411, 421 consecutively hold to data lines $D_1$, $D_2$. When sampling switch S4 is turned on, sample/hold circuit 440 samples the data current applied through signal line $X_1$ into storage element 441.

As described, sample/hold circuits 410, 420, 430, 440 of demultiplexer 401 are classified into two groups according to the sampling and holding operations. Sample/hold circuits 430, 440 of a second group hold previously sampled data to data lines $D_1$, $D_2$, while sample/hold circuits 410, 420 of a first group perform sampling of data current applied through signal line $X_1$. In a like manner, sample/hold circuits 410, 420 of the first group hold the previously sampled data while sample/hold circuits 430, 440 of the second group perform sampling. Since, according to one embodiment of the invention, holding switches H1, H2 are operated at substantially the same time, they may be driven with the same control signal, and holding switches H3, H4 may be driven with a same control signal in a like manner.

In this instance, time periods T1, T2 correspond to a period during which data is applied to a pixel circuit coupled to one row of a scan line according to a select signal (hereinafter referred to as a "horizontal period"), and time periods T3, T4 correspond to a next horizontal period. Sufficient time for programming data to the pixels may therefore be obtained since the data current may be consecutively applied to a particular data line during each horizontal period, and the data current may be transmitted to the particular data line during a particular frame since time periods T1 to T4 are repeated.

Since the four sample/hold circuits included in the demultiplexer of FIG. 5 may be substantially identically realized, sample/hold circuit 410 of FIG. 5 will be described in detail with reference to FIG. 8.

Figure 8:
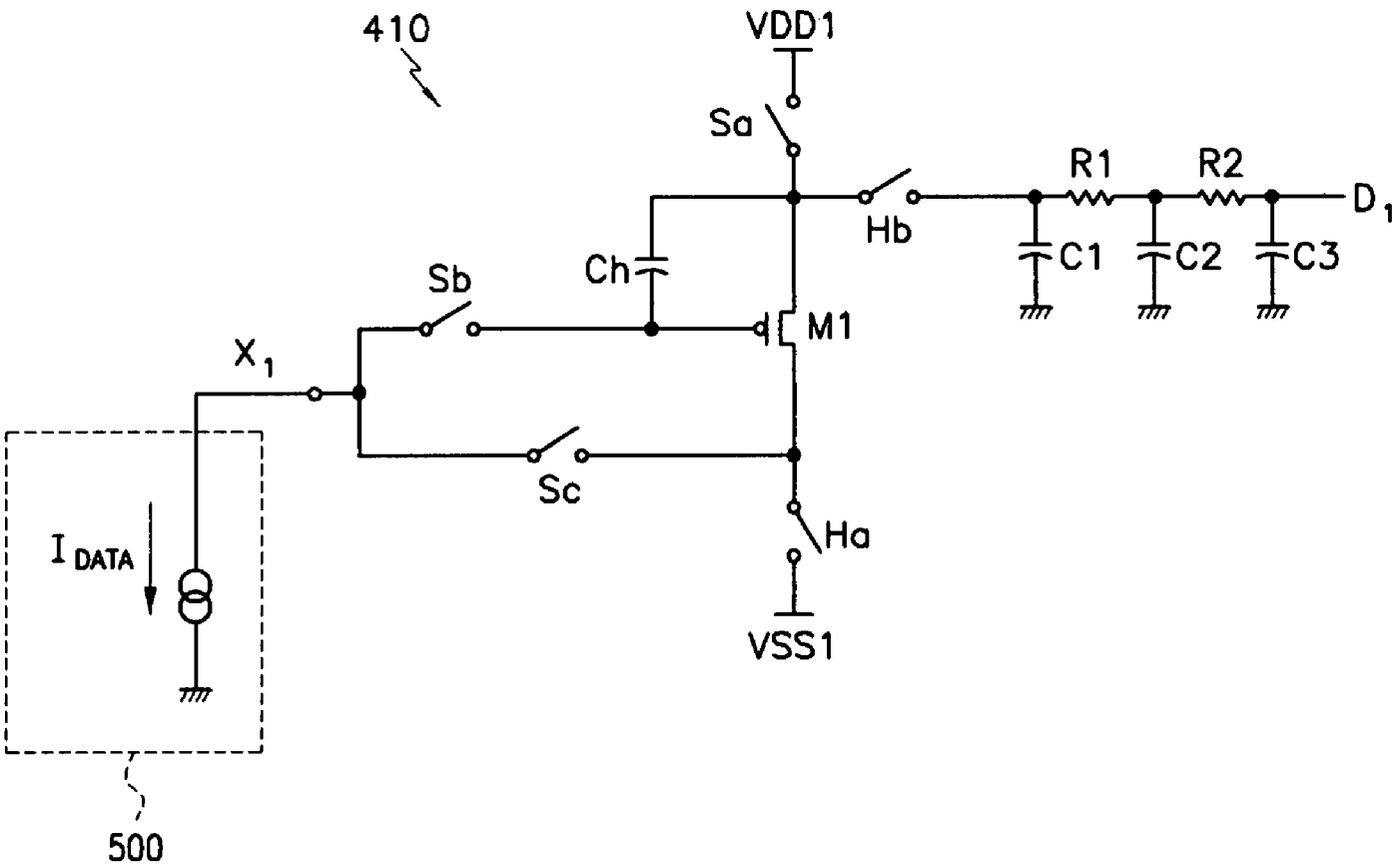
FIG. 8 shows a simplified circuit diagram of the sample/hold circuit of FIG. 5.

Sample/hold circuit 410 of FIG. 8 is coupled between signal line $X_1$ and data line $D_1$, and includes transistor M1, capacitor Ch, and five switches Sa, Sb, Sc, Ha, Hb. Parasitic resistance components and parasitic capacitance components are formed in data line $D_1$, where parasitic resistance components are exemplified to be R1 and R2, and parasitic capacitance components are exemplified to be C1, C2, and C3. Transistor M1 is, according to one embodiment, a p-channel field-effect transistor, in particular, a metal oxide semiconductor field-effect transistor (MOSFET).

Switch Sa is coupled between power supply voltage VDD1 and a source of transistor M1. Switch Ha is coupled between power supply voltage VSS1 and a drain of transistor M1. Since, according to the illustrated embodiment, transistor M1 is a p-channel type, power supply voltage VDD1 has a voltage greater than power supply voltage VSS1, and it is supplied by vertical lines $V_1$ to $V_n$ coupled to power line 700. Switch Sb is coupled between signal line $X_1$ which is an input terminal and the gate of transistor M1, and switch Hb is coupled between the source of transistor M1 and data line $D_1$ which is an output terminal. Switch Sc is coupled between signal line $X_1$ and the drain of the transistor, and diode-connects transistor M1 when switches Sb and Sc are turned on. In this instance, switch Sc can be coupled between the gate and the drain of transistor M1 to diode-connect transistor M1. When switch Sc is coupled between the gate and the drain of transistor M1, switch Sb can be coupled between signal line $X_1$ and the drain of transistor M1.

An operation of sample/hold circuit 410 of FIG. 8 will be described. According to one embodiment, switches Sa, Sb, Sc are turned on/off at substantially the same time, and switches Ha, Hb are turned on/off at substantially the same time.

When switches Sa, Sb, Sc are turned on and switches Ha, Hb are turned off, transistor M1 is diode-connected, the current is supplied to capacitor Ch which is then charged with a voltage, the gate potential of transistor M1 is lowered, and the current accordingly flows to the drain from the source. Upon passage of a certain period of time, the charged voltage of capacitor Ch is increased, and the drain current of transistor M1 corresponds to data current $I_{DATA}$ provided from signal line $X_1$, the charged current of capacitor Ch is no longer increased, and hence, capacitor Ch is charged with a constant voltage. In this instance, the relation between an absolute value $V_{SG}$ of a voltage between the source and the gate of transistor M1 (hereinafter referred to as a "source-gate voltage") and data current $I_{DATA}$ provided from signal line $X_1$ satisfies Equation 1. In this manner, sample/hold circuit 410 samples the data current provided from signal line $X_1$.

$$I_{DATA} = \frac{\beta}{2}(V_{SG} - V_{TH})^2 \qquad \text{Equation 1}$$

where β is a constant determined by a channel width and a channel length of transistor M1, and $V_{TH}$ is an absolute value of a threshold value of transistor M1.

When switches Sa, Sb, Sc are turned off and switches Ha, Hb are turned on, the current corresponding to source-gate voltage $V_{SG}$ charged in capacitor Ch, that is, data current $I_{DATA}$ is transmitted to data line $D_1$ through switch Hb. In this manner, sample/hold circuit 410 holds the current to data line $D_1$.

Sample/hold circuit 410 maintains the voltage charged in capacitor Ch since switches Sa, Sb, Sc, Ha, Hb are turned off while sample/hold circuit 420 of FIG. 5 performs sampling at time period T2. That is, sample/hold circuit 410 enters a standby state.

Switches Sa, Sb, Sc correspond to sampling switch S1 of FIG. 5 since sample/hold circuit 410 performs sampling when switches Sa, Sb, Sc are turned on, and switches Ha, Hb correspond to holding switch H1 of FIG. 5 since sample/hold circuit 410 performs holding when switches Ha, Hb are turned on. Capacitor Ch and transistor M1 correspond to data storage element 411 since they function to store a voltage corresponding to the data current. Switches Sa, Sb, Sc, Ha, Hb may be realized with p-channel or n-channel FETS. Furthermore, switches Sa, Sb, Sc may be realized with same conductivity type transistors, and switches Ha, Hb realized with same conductivity type transistors in a similar manner. Furthermore, switches Sa, Sb, Sc may be realized with the p-channel transistors and switches Ha, Hb realized with n-channel transistors so that they may be driven according to the timing diagram of FIG. 6.

Sample/hold circuit 410 of FIG. 8 sources the data current to signal line $X_1$, that is, the input terminal, during the sampling operation, and sinks the data current from data line $D_1$, that is, the output terminal during the holding operation. Accordingly, sample/hold circuit 410 shown in FIG. 8 may be used together with data driver 500 for sinking the data current at signal line $X_1$, that is, a data driver having a current sink type output terminal. Since a driving IC having a current sink type output terminal is generally cheaper than a driving IC having a current source type output terminal, the cost of the data driver 500 is reduced.

Also, when transistor M1 is realized with an n-channel FET and the relative voltage levels of power supply voltages VDD1 and VSS1 are exchanged with each other in FIG. 8, a sample/hold circuit having a current sink type input terminal and a current source type output terminal may be realized. No detailed description on the configuration of the sample/hold circuit will be provided since it will be apparent to a person of skill in the art.

As described, the demultiplexer of FIG. 5 sequentially samples the data current that has been time-divided and applied through signal line X1 during one horizontal period, and concurrently applies the sampled current to the data lines $D_1$, and $D_2$ during the next horizontal period. While performing a 1:N demultiplexing operation, the time for the demultiplexer to sample the data current corresponding to a single data line $D_1$, is about 1/N of one horizontal period. Therefore, demultiplexer 400 must generally sample the data current corresponding to a single data line during the time corresponding to 1/N of one horizontal period. In order to satisfy the condition, the capacitance component at signal line $X_1$ when data driver 500 applies the data current through signal line $X_1$ should be less than 1/N of the capacitance component at data line $D_1$ when demultiplexer 400 applies the sampled current through one data line $D_1$.

When applying the data current corresponding to a particular data line to demultiplexer unit 400 through signal line $X_1$, data driver 500 drives parasitic capacitance component C1 formed by signal line $X_1$ and power line 700. In the case where metallic select scan lines $SE_1$ to $SE_m$ and emit scan lines $EM_1$ to $EM_m$ are insulated from data line $D_1$ and cross data line $D_1$ in display area 100, demultiplexer unit 400 drives the parasitic capacitance component C2 formed by data line $D_1$, select scan lines $SE_1$ to $SE_m$, and emit scan lines $EM_1$ to $EM_m$ when applying the sampled data current to data line $D_1$.

In general, the capacitance formed by two metallic plates is in proportion to the area of the facing metallic plates and is in inverse proportion to the distance between the two plates when the same dielectric matter is provided therebetween. The distances between the two facing metallic plates correspond to each other in parasitic capacitance components C1 and C2, and a length of one side of the metallic plate forming parasitic capacitance component C1 is given as a width of signal line $X_1$, a length of another side of parasitic capacitance component C1 is given as the width of power line 700, a length of one side of the metallic plate for forming parasitic capacitance component C2 is given as a width of data line $D_1$, and a length of another side of parasitic component C2 is given as the summation of widths of m select scan lines $SE_1$ to $SE_m$ and m emit scan lines $EM_1$ to $EM_m$.

For example, when widths of one of select scan lines $SE_1$ to $SE_m$ and one of emit scan lines $EM_1$ to $EM_m$ are respectively 7 μm, the width of power line 700 is 2 mm, and the width of data line $D_1$ corresponds to the width of signal line $X_1$ in the QCIF resolution (i.e., 176×220), the magnitude of capacitance component C1 becomes about ⅔ (2,000/(7×220×2)) of capacitance component C2. Accordingly, the above-described condition of 1/N is not satisfied, the demultiplexer unit cannot sample the current within the given time, and hence, the current sampling rate is to be increased, which will be described in detail with reference to FIGS. 9 to 12.

Figure 9:
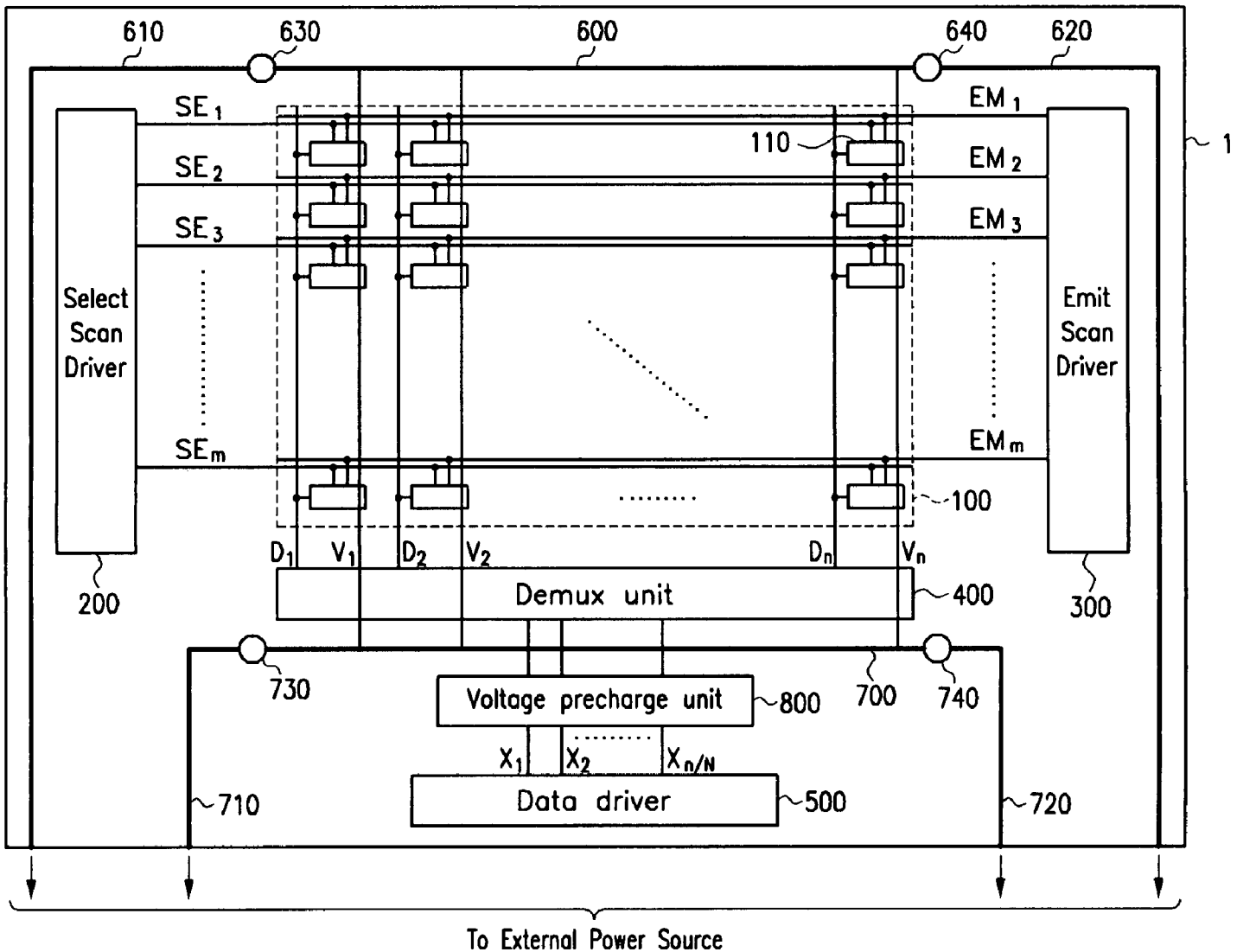
FIG. 9 shows a simplified plane view of a display device using a demultiplexer according to a second exemplary embodiment of the present invention.

FIG. 9 shows a simplified plane view of a display device using a demultiplexer according to a second exemplary embodiment of the present invention.

As shown, the display device includes voltage precharge unit 800 provided between demultiplexer 400 and data driver 500. Voltage precharge unit 800 transmits a precharge voltage $V_{pre}$ to signal lines $X_1$ to $X_{n/N}$ before data driver 500 transmits the data current to demultiplexer unit 400. Voltage precharge unit 800 is formed between data driver 500 and power line 700 in order to charge signal lines $X_1$ to $X_{n/N}$ having the capacitance component formed by signal lines $X_1$ to $X_{n/N}$ and power line 700.

Although voltage precharge unit 800 is illustrated in FIG. 9 to be formed in an outer surrounding area of data driver 500, a person of skill in the art will recognize that voltage precharge unit 800 may alternatively be formed within data driver 500.

Figure 10:
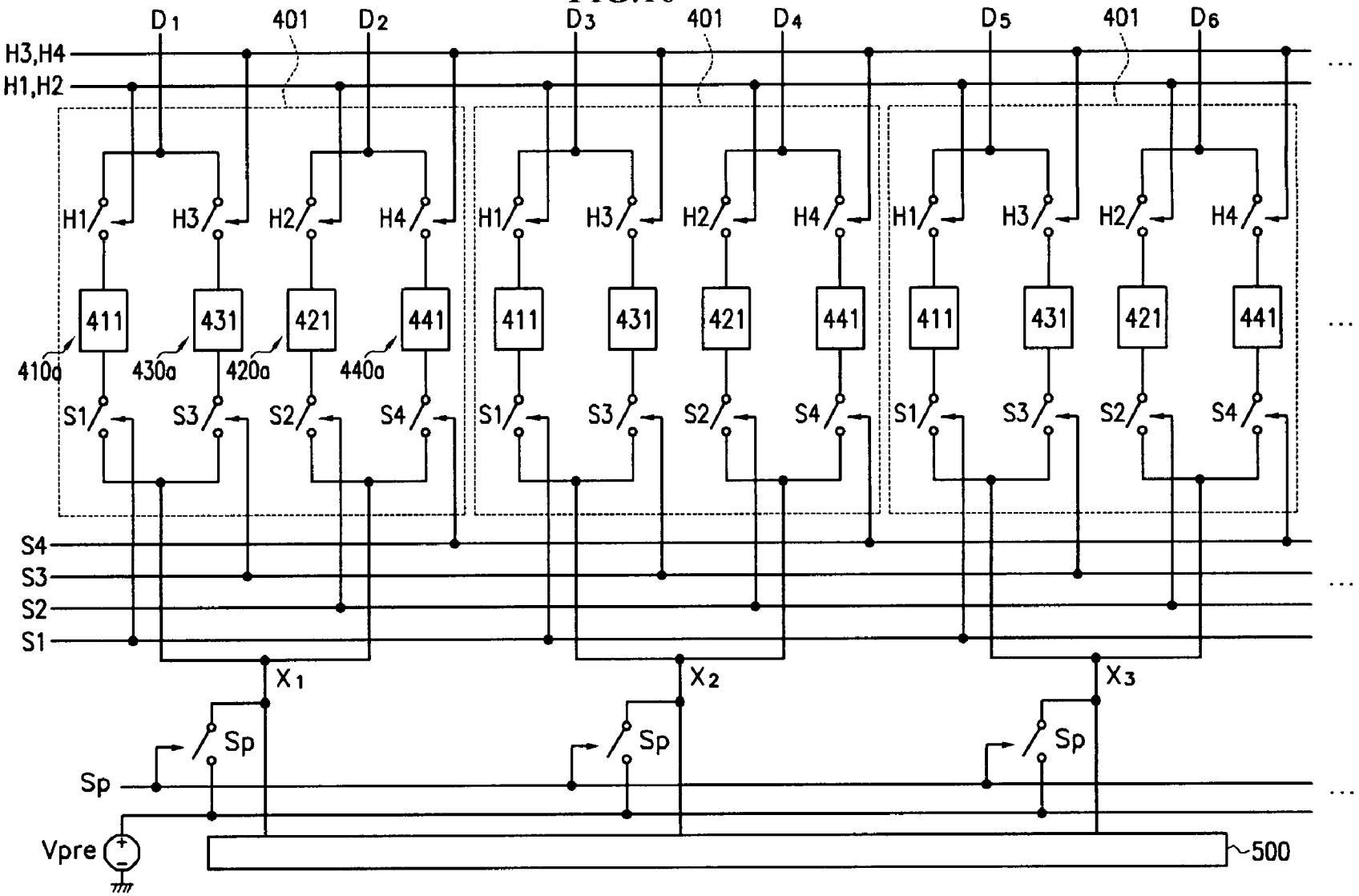
FIG. 10 shows a diagram of a data driver, a voltage precharge unit, and a demultiplexer unit of FIG. 9.
Figure 11:
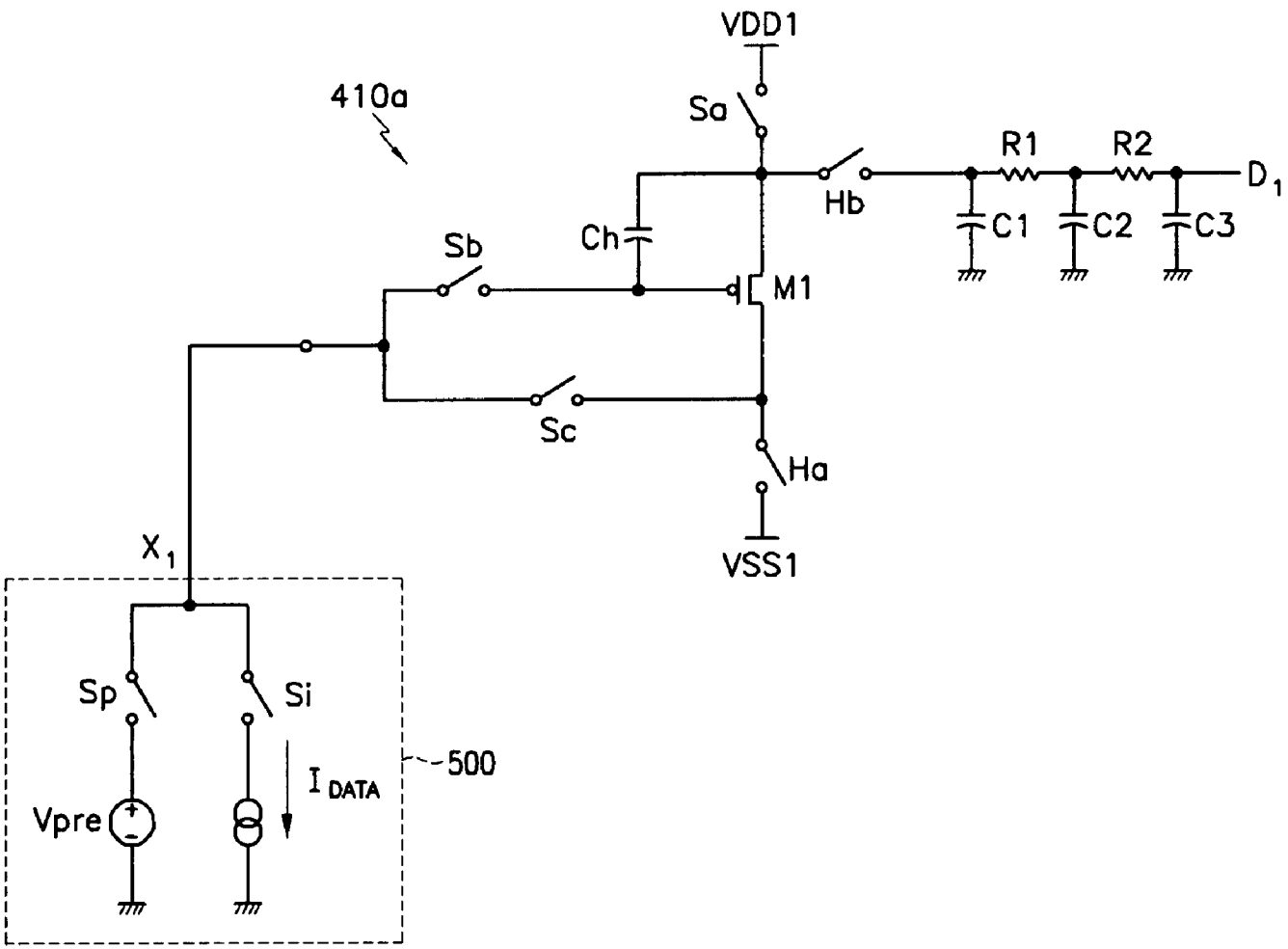
FIG. 11 shows a sample/hold circuit.

Referring to FIGS. 10 and 11, voltage precharge unit 800 of FIG. 9 will be described in detail. For ease of description, demultiplexer unit 400 coupled to voltage precharge unit 800 is described to perform 1:2 demultiplexing. FIG. 10 shows a diagram for data driver 500, voltage precharge unit 800, and demultiplexer unit of FIG. 9, and FIG. 11 shows a sample/hold circuit.

Referring to FIG. 10, voltage precharge unit 800 includes a plurality of switches Sp respectively coupled between a precharge power source for supplying precharge voltage $V_{pre}$ and signal lines $X_1$ to $X_{n/2}$. According to one embodiment, the precharge power source is formed outside of substrate 1 and coupled to switch Sp through the previously-mentioned pad (not illustrated). Switch Sp is turned on while precharge voltage $V_{pre}$ is applied to signal lines $X_1$ to $X_{n/2}$, and turned off while data current is applied.

Since one sample/hold circuit corresponding to the data current from among sample/hold circuits 410*a*, 420*a*, 430*a*, 440*a* of demultiplexer 401 samples the applied data current according to the data current that has been time-divided and applied by data driver 500, sample/hold circuit 410*a* coupled between signal line $X_1$ and data line $D_1$ will be described with reference to FIG. 11. Data driver 500 for supplying data current $I_{DATA}$ is illustrated in FIG. 11 to be a current source. For ease of description, the current source is described to be coupled to signal line $X_1$ through switch Si.

Figure 12:
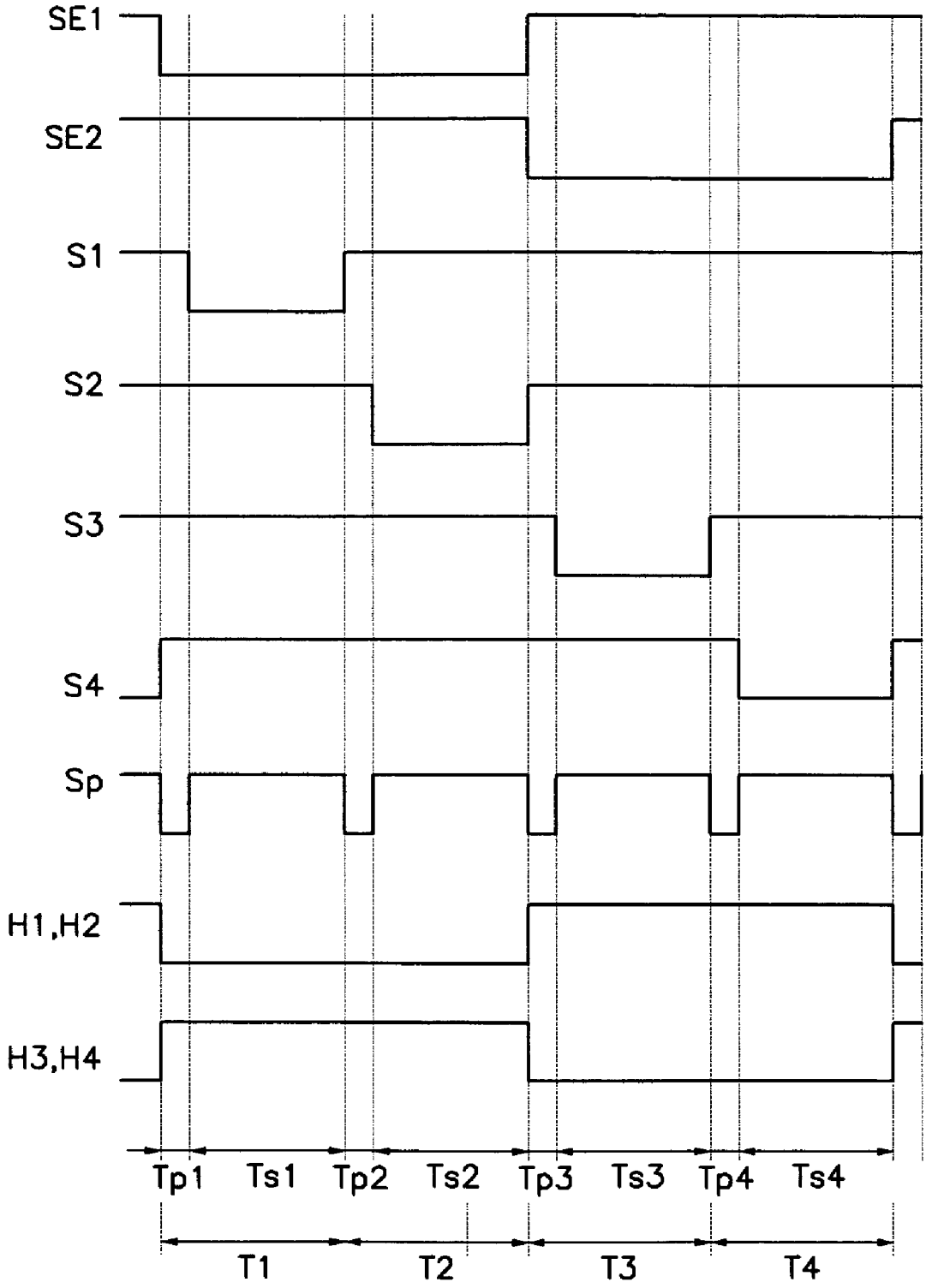
FIG. 12 shows a driving timing diagram for a precharge method according to a second exemplary embodiment of the present invention.

Referring to FIG. 12, an operation of sample/hold circuit 410*a* of FIG. 11 will be described in detail.

FIG. 12 shows a driving timing diagram for a precharge method according to the second exemplary embodiment of the present invention. Referring to FIG. 12, switch Sp and sampling switches S1, S2, S3, S4, that is, switches Sa, Sb, and Sc are turned on when a control signal level is low, and holding switches H1, H2, H3, H4, that is, switches Ha, Hb are turned on when the control signal level is high.

Referring to FIG. 12, a precharge operation is performed during precharge period Tp1 before sample/hold circuit 410 samples the data current so as to reduce the sampling time. In detail, switch Sp is first turned on and precharge voltage $V_{pre}$ is applied to signal line $X_1$.

Next, switch Sp is turned off to intercept precharge voltage $V_{pre}$, and switch Si is turned on to apply the data current and turn on switches Sa, Sb, and Sc corresponding to switch S1 of FIG. 10, during sampling period Ts1. Data current $I_{DATA}$ is transmitted to the drain of transistor M1 through signal line $X_1$. This causes capacitor Ch to be charged with source-gate voltage $V_{GS}$ of transistor M1 corresponding to data current $I_{DATA}$. In this instance, since precharge voltage $V_{pre}$ is applied to signal line $X_1$ according to the precharge operation, a voltage corresponding to data current $I_{DATA}$ is quickly charged in capacitor Ch even when a parasitic capacitance component is provided in signal line $X_1$.

The precharge operation has been described by using sample/hold circuit 410*a* as an example. The precharge operation may be performed before a sampling operation in the scenario where sample/hold circuits 410*a*, 420*a*, 430*a*, 440*a* sequentially perform the sampling operation in demultiplexer 401. That is, as shown in FIG. 12, periods T1, T2, T3, T4 in the driving timing diagram of FIG. 6 are divided into precharge periods Tp1, Tp2, Tp3, Tp4 and sampling periods Ts1, Ts2, Ts3, Ts4. Accordingly, data current $I_{DATA}$ may be sampled earlier in time since signal line $X_1$ is charged with precharge voltage $V_{pre}$ before sample/hold circuits 410*a*, 420*a*, 430*a*, 440*a* sample data current $I_{DATA}$.

Levels of the precharge voltage $V_{pre}$ for sampling the data current $I_{DATA}$ within a given time will be described with reference to FIG. 13.

Figure 13:
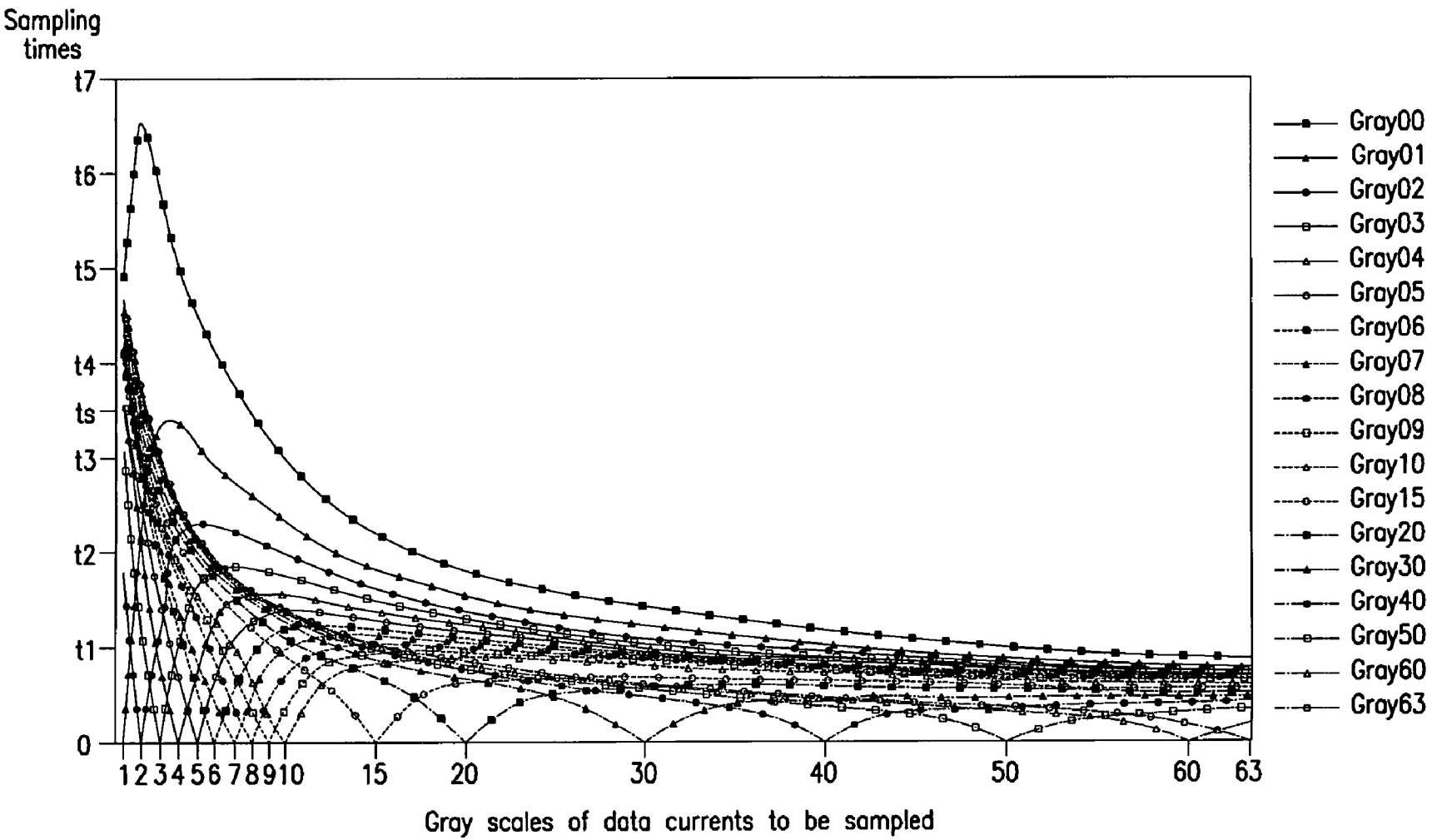
FIG. 13 shows a graph of various gray scales of data current to be sampled and the sampling time for the various gray scales.

FIG. 13 is a graph illustrating an amount of sampling time taken to sample the data current at a present sampling period according to gray scales of the data current applied at a previous sampling period in the case of no precharging.

Specifically, FIG. 13 illustrates times in which sample/hold circuit 420*a* samples the data current applied through signal line $X_1$ during present sampling period Ts2 after sample/hold circuit 410*a* samples the data current applied through signal line $X_1$ during previous sampling period Ts1. The horizontal axis corresponds to respective grays scales of the data current sampled during the previous sampling period, and the vertical axis represents a sampling time according to the gray of the data current to be sampled during the present sampling period.

For example, when the gray scale of the data current applied during the previous sampling period is 8, signal line $X_1$ is charged with a voltage corresponding to the gray scale of 8, and hence, when the data current at the gray scale of 8 is applied to the signal line $X_1$ during the present sampling period, the voltage at the signal line $X_1$ reaches the voltage (a target voltage) corresponding to the gray scale of 8 almost immediately. That is, the time for sampling is very close to 0. The sampling time increases since the further the gray scale is from 8, the greater the difference between the voltage state of signal line $X_1$, and the target voltage.

The time for sampling is in inverse proportion to the magnitude of the data current for driving the signal line $X_1$. Therefore, when the gray scale is lowered, the data current is reduced, and the time for sampling is steeply increased. However, when the gray scale becomes higher after a certain predetermined level, the data current is increased, and accordingly, the time for sampling is reduced. Therefore, the curves in the graph of FIG. 13 are steeply reduced following the positive horizontal axis, are increased to form apexes when they meet the horizontal axis, and are gradually reduced again.

As is illustrated in FIG. 13, gray scales of greater than 8 may be sampled within sampling time $t_s$ irrespective of gray levels of the data current of the previous sampling period. Gray scales of equal to or less than 7 call for a sampling time greater than sampling time $t_s$ when the given sampling time is $t_s$ because of the residual voltage in the parasitic capacitance formed in signal line $X_1$ according to the data current applied during the previous sampling period.

As is also illustrated in FIG. 13 the curves with the gray scales of 1 to 4 of the data current applied during the previous sampling period are provided below sampling time $t_s$. That is, when precharge voltage $V_{pre}$ is established to be within a voltage range with gray scales of 1 to 4, the same effect is obtained such that the voltage corresponding to the gray scales of 1 to 4 is charged in signal line X1 during the previous sampling period, and hence, sample/hold circuit 420*a* may sample the data currents of all the gray scales within time $t_s$. In this instance, time $t_s$ corresponds to sampling period Ts2 of FIG. 12. In this instance, the voltage of the gray scale corresponding to the precharge voltage is determined according to the sampling period Ts1. Therefore, while modifying the gray scale of the data current sampled during the previous sampling period, sample/hold circuit 420*a* measures the gray scale of the data current of the previous sampling period during which the data current of gray scales can be sampled in the given sampling period Ts1. Accordingly, a range of a gray scale of the previous sampling period during which the gray scale is sampled within a given sampling period is determined, and a precharge voltage range $R_y$ for establishing the precharge voltage $V_{pre}$ is determined according to the range of the gray scale.

Since a deviation is provided between transistor M1 and power supply voltage VDD1 of sample/hold circuit in demultiplexer unit 400, precharge voltage range $R_y$ may be established in the sample/hold circuit having representative values (including a mean value and a median value) of the threshold value in order to reduce errors caused by the deviation. The deviation of the threshold voltage can be applied to the established precharge voltage range $R_y$, which will now be described.

First, the deviation of the threshold voltage of transistor M1 is applied to the precharge voltage $V_{pre}$ in a third exemplary embodiment. That is, the deviation of the threshold voltage of the transistor in demultiplexer unit 400 is applied to precharge voltage range $R_y$ determined in the sample/hold circuit having the representative values of the threshold voltage of the second embodiment, in the third embodiment.

In detail, the sample/hold circuit using transistor M1 having a threshold voltage which is higher, by a voltage of $|\Delta V1|$, than the absolute value of the threshold voltage of transistor M1 of the sample/hold circuit used for establishing precharge voltage range $R_y$ in the second embodiment, that is, the absolute value $|V_{TH}|$ of the representative value of the threshold value has a gate voltage of transistor M1 which is lower than the case of the same current by the voltage of $|\Delta V1|$. Since the gate voltage of transistor M1 is a voltage charged in signal line $X_1$, application of the same precharge voltage Vpre1 to the sample/hold circuit is substantially similar to applying the voltage of $(V_{pre1}+|\Delta V1|)$ obtained by adding the voltage of $|\Delta V1|$ to precharge voltage $V_{pre1}$ thereto as a precharge voltage. Therefore, when precharge voltage $V_{pre1}$ is included in precharge voltage range $R_y$, the precharge voltage of $(V_{pre1}+|\Delta V1|)$ may digress from precharge voltage range $R_y$ in the sample/hold circuit using transistor M1 with a large absolute value of the threshold value.

In a like manner, the sample/hold circuit using transistor M1 having a threshold voltage with an absolute value lower than the absolute value $|V_{TH}|$ of the threshold voltage of transistor M1 of the sampling/hold circuit used for establishing precharge voltage range $R_y$ in the second embodiment by a voltage of $|\Delta V2|$ has a gate voltage of transistor M1 higher by a voltage of $|\Delta V2|$ with respect to the same current. Applying the same precharge voltage $V_{pre1}$ to the sample/hold circuit substantially corresponds to applying the voltage of $(V_{pre1}-|\Delta V2|)$ obtained by subtracting the voltage of $|\Delta V2|$ from the voltage of $V_{pre1}$ thereto as the precharge voltage in the above-described sample/hold circuit. Therefore, the precharge voltage of $(V_{pre1}-|\Delta V2|)$ may digress from precharge voltage range $R_y$ in the sample/hold circuit using transistor M1 with a lesser absolute value of the threshold value when precharge voltage Vpre1 is included in precharge voltage range $R_y$.

Therefore, according to the third embodiment, a voltage range which is lower than precharge voltage range $R_y$ by $|\Delta V1|$ may be established to be the precharge voltage range when the absolute value of the threshold voltage is higher than the absolute value of the representative value by $|\Delta V1|$. Also, a voltage range which is higher than precharge voltage range $R_y$ by $|\Delta V2|$ may be established to be the precharge voltage range when the absolute value of the threshold voltage is lower than the absolute value of the representative value by $|\Delta V2|$. Accordingly, when considering the deviation of the threshold voltages of sample/hold circuits, the difference of $|\Delta V3|$ between the absolute value of the representative value of the threshold value and the maximum value of the absolute value of the threshold value, and the difference of $|\Delta V4|$ between the absolute value of the representative value of the threshold value and the minimum value of the absolute value of the threshold, are applied to precharge voltage range $R_y$.

When the maximum value in precharge voltage range $R_y$ is a voltage of $V_{max}$ and the minimum value is a voltage of $V_{min}$, precharge voltage $V_{pre}$ is determined within the range given in Equation 2.

$$V_{min}+|\Delta V4| \leqq V_{pre} \leqq V_{max}-|\Delta V3| \qquad \text{Equation 2}$$

A fourth exemplary embodiment addressing a voltage drop of power supply voltage VDD1 in the case of establishing the precharge voltage will now be described. The deviation of power supply voltage VDD1 caused by the voltage dropping generated according to the power line supplying power supply voltage VDD1, is applied to precharge voltage range $R_y$.

In detail, when the data current of the black gray scale (the gray scale of 0) is applied to signal lines $X_1$ to $X_{n/2}$, power supply voltage VDD1 is substantially identically transmitted to the sample/hold circuits since no voltage drop is generated by the parasitic resistance. When the data current of the white gray scales (gray scales of 256 and 255) are applied to signal lines $X_1$ to $X_{n/2}$, power supply voltages VDD1 are different for the respective sample/hold circuits since a substantial voltage drop is generated by the parasitic resistance. The difference between the voltage of the lowest level from among the power supply voltages applied to the respective sample/hold circuits and power supply voltage VDD1 will be referred to as ΔVDD.

In this instance, since the gate voltage at transistor M1 is lowered by ΔVDD when a current, corresponding to the current flowing to transistor M1 of the sample/hold circuit with power supply voltage of VDD, flows to transistor M1 of the sample/hold circuit with power supply voltage of (VDD1−ΔVDD), applying the precharge voltage Vpre1 is substantially similar to applying the precharge voltage of ($V_{pre1}$+ΔVDD).

Therefore, precharge voltage $V_{pre}$ can be given as Equation 3 in consideration of the voltage drop caused by the parasitic resistance of the power line in the fourth embodiment.

$$V_{min} \leqq V_{pre} \leqq V_{max} - |\Delta VDD| \quad \text{Equation 3}$$

where $V_{min}$ is the minimum voltage within precharge voltage range $R_y$, and $V_{max}$ is the maximum voltage within precharge voltage range $R_y$.

Precharge voltage $V_{pre}$ may be given as Equation 4 in consideration of the deviation of the threshold voltage of transistor M1 and the deviation of power supply voltage VDD1 described in the second and third embodiments.

$$V_{min} + |\Delta V4| \leqq V_{pre} \leqq V_{max} - |\Delta V3| - |\Delta VDD| \quad \text{Equation 4}$$

The ranges of the precharge voltages have been described above. The respective sample/hold circuit units correspond to one of the red, green, and blue pixels since one sample/hold circuit unit corresponds to one data line. The voltage ranges of the precharge voltages may be differently established for the respective sample/hold circuits corresponding to the pixels of the respective colors since the ranges of the currents used for the respective colors are different.

Voltage precharge unit 800 has been described to be provided between driver 500 and power line 700 in the second to fourth embodiments. According to another embodiment, voltage precharge unit 800 may be formed between power line 700 and demultiplexer unit 400. The driving methods described in the second to fourth embodiments are also applicable to this embodiment.

Also, power supply voltage VDD1 of the sample/hold circuit has been described to be supplied from vertical lines $V_1$ to $V_n$ coupled to power line 700. According to another embodiment, power supply voltage VDD1 may be supplied from lines other than vertical lines $V_1$ to $V_n$ coupled to power line 700. The driving method described in the fourth to fifth embodiments may also be applied to the embodiment where power line 700 is not coupled to vertical lines $V_1$ to $V_n$.

Figure 14:
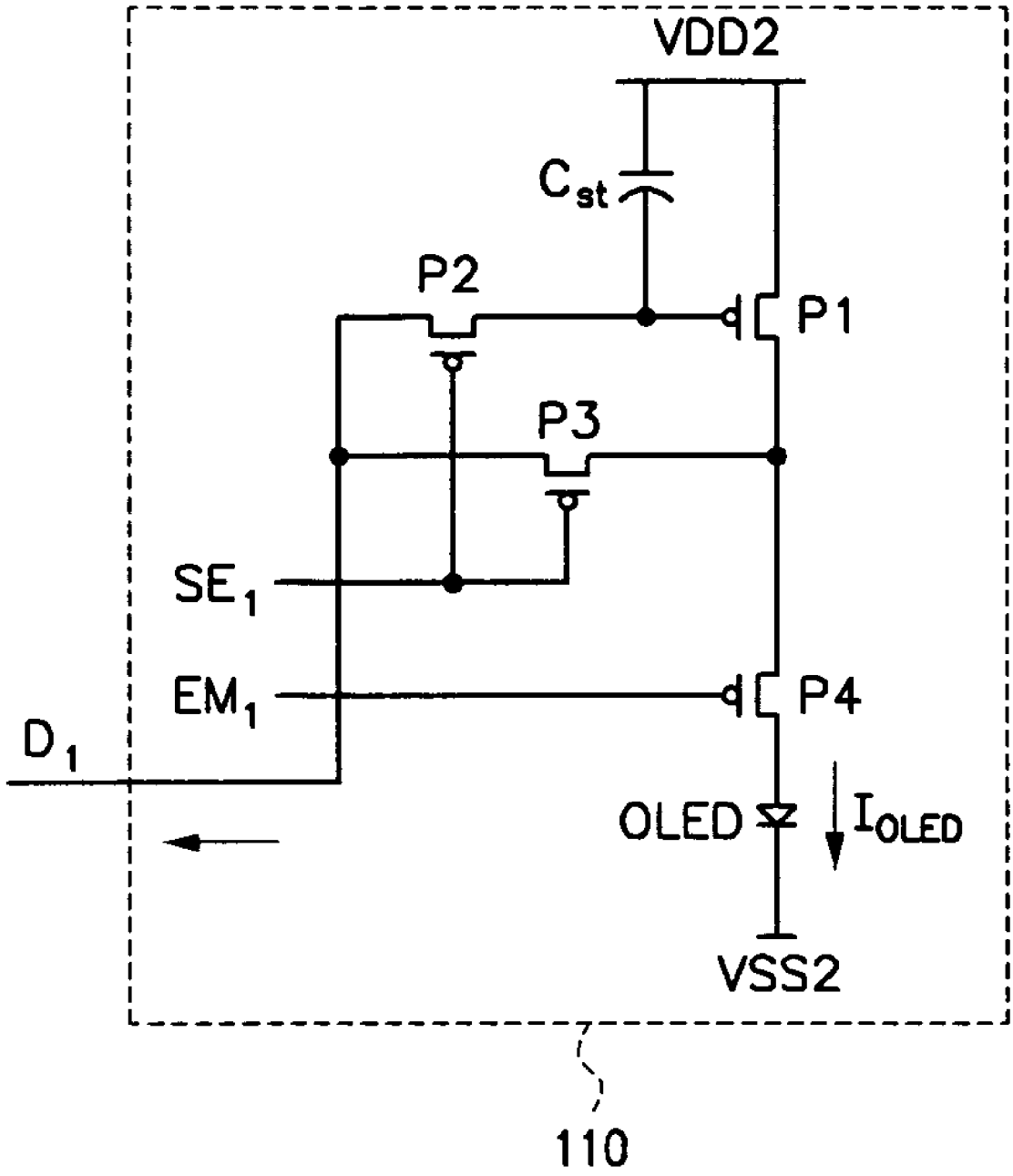
FIG. 14 shows a simplified circuit diagram of a pixel circuit.

Referring to FIG. 14, a pixel circuit formed at the pixel area of a display device according to the first to fourth embodiments will be described. FIG. 14 shows a simplified circuit diagram of the pixel circuit.

As shown, the pixel circuit 110 is coupled to the data line D1, and data is programmed to pixel circuit 110 by the current. According to one embodiment, pixel circuit 110 uses an electroluminescent emission of organic matter. The pixel circuit 110 includes four transistors P1, P2, P3, P4, capacitor Cst, and a light emitting element such as an organic light emitting diode (OLED). Transistors P1, P2, P3, P4 in FIG. 14 are illustrated to be p-channel FETs.

The source of transistor P1 is coupled to power supply voltage VDD2, and capacitor Cst is coupled between the source and the gate of transistor P1. Transistor P2 is coupled between data line $D_1$ and the gate of transistor P1 and responds to a select signal provided from select scan line $SE_1$. Transistor P3 is coupled between the drain of transistor P1 and data line $D_1$, and diode-connects transistor P1 together with transistor P2 in response to the select signal provided from select scan line $SE_1$. Transistor P4 is coupled between the drain of transistor P1 and light emitting element OLED, and transmits the current provided by transistor P1 to light emitting element OLED in response to an emit signal provided from emit scan line $EM_1$. The cathode of light emitting element OLED is coupled to power supply voltage VSS2 which is lower than power supply voltage VDD2.

In this instance, when transistors P2 and P3 are turned on by the select signal provided from select scan line $SE_1$, the current provided from data line $D_1$ flows to the drain of transistor P1, and the source-gate voltage at transistor P1 corresponding to the current is stored in capacitor Cst. When an emit signal is applied from emit scan line $EM_1$, transistor P4 is turned on, current $I_{OLED}$ of transistor P1 corresponding to the voltage stored in capacitor Cst is supplied to light emitting element OLED, and light emitting element OLED accordingly emits light.

As described, since power supply voltage VDD2 is supplied through vertical line $V_1$ and power lines 600 and 700 for transmitting the voltage to vertical line $V_1$ are respectively formed on the top and bottom of the display area in the pixel circuit, the voltage drop at vertical line $V_1$ is reduced.

The demultiplexer unit has been described to perform 1:2 demultiplexing, and without being restricted to this, it is also applicable to a demultiplexer unit for performing 1:N demultiplexing (where N is an integer equal to or greater than 2).

The voltage drop at the vertical line may be reduced by providing an additional power line for supplying the power supply voltage in the display device using the demultiplexer, and the data current may be sampled within the given time by precharging the signal line provided between the demultiplexer unit and the data driver by using the voltage.

While this invention has been described in connection with what is presently considered to be the practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device comprising:

a display area including a plurality of data lines for transmitting data currents for displaying images, and a plurality of pixel circuits coupled to the data lines;

a plurality of first signal lines;

a data driver coupled to the first signal lines for time-dividing a first current corresponding to the data currents and transmitting the time-divided first current to the first signal lines;

a demultiplexer unit including a plurality of demultiplexers for respectively receiving the first current from the first signal lines and transmitting the data currents to at least two data lines; and a precharge unit coupled between the demultiplexer unit and the data driver for transmitting a precharge voltage to the first signal lines before the data driver transmits the time-divided first current to the first signal lines for each of the data currents, wherein each of the pixel circuits includes a transistor to which the data current flows from a corresponding one of the data lines, a capacitor coupled between the source and the gate of the transistor and for storing a voltage corresponding to the current flowing to the transistor; and a light emitting element for emitting light corresponding to the current flowing to the transistor according to the voltage stored in the capacitor.

2. The display device of claim 1, wherein the demultiplexer includes a plurality of sample/hold circuits coupled to the first signal lines, and sample/hold circuits of a first group of the plurality of sample/hold circuits concurrently hold current sampled during a previous horizontal period to at least two data lines of the data lines, and sample/hold circuits of a second group sequentially sample the first current sequentially applied through the first signal lines during a particular horizontal period.

3. The display device of claim 2, wherein the sample/hold circuits include:

first and second sample/hold circuits having input terminals coupled to one of the first signal lines and output terminals coupled to a first data line of the at least two data lines; and third and fourth sample/hold circuits having input terminals coupled to one of the first signal lines and output terminals coupled to a second data line of the at least two data lines, wherein the first and third sample/hold circuits form the first group of sample/hold circuits, and the second and fourth sample/hold circuits form the second group of sample/hold circuits.

4. The display device of claim 2, wherein the precharge voltage is a voltage for allowing the first current transmitted to the first signal line to be substantially sampled within a given sampling time after the precharge voltage is applied.

5. The display device of claim 2, wherein the precharge voltage is a voltage between a first voltage corresponding to a current for a first gray level and a second voltage corresponding to a current for a second gray level when the first current applied to a one of the first signal lines is substantially sampled within a current sampling period after the first current with the first gray level or the second gray level is transmitted to the one of the first signal lines during a previous sampling period.

6. The display device of claim 5, wherein the sample/hold circuit includes a sampling switch turned on in response to a sampling signal, a holding switching turned on in response to a holding signal, and a data storage element for sampling the first current when the sampling switch is turned on and holding the sampled current when the holding switch is turned on, and wherein the sampling signal is sequentially applied to the sample/hold circuits.

7. The display device of claim 6, wherein the data storage element includes:

a transistor having a source coupled to a first power source and having a gate and a drain coupled to the one of the first signal lines in response to the sampling signal; and a capacitor coupled between the gate and the source of the transistor of the data storage element for storing a voltage corresponding to the current transmitted to the drain of the transistor of the data storage element.

8. The display device of claim 7, wherein the precharge voltage is a voltage between a fourth voltage and a second voltage when the first voltage is closer to a voltage of the first power source than is the second voltage, the difference between a maximum value and a representative value in absolute values of threshold voltages of transistors included in the sample/hold circuits is a third voltage, and the fourth voltage is a voltage further from the voltage of the first power source by an amount of the third voltage than is the first voltage.

9. The display device of claim 8, wherein the precharge voltage is a voltage between a sixth voltage and the fourth voltage when the difference between the representative value and the maximum value in absolute values of the threshold voltages of the transistors included in the sample/hold circuits is a fifth voltage, and the sixth voltage is a voltage closer to the voltage of the first power source by an amount of the fifth voltage than is the second voltage.

10. The display device of claim 7, wherein the precharge voltage is a voltage between the fourth voltage and the second voltage when the difference between the maximum value and the minimum value in the voltages of the first power source of the sample/hold circuits is the third voltage, the first voltage is closer to the voltage of the first power source than is the second voltage, and the fourth voltage is a voltage further from the voltage of the first power source by an amount of the third voltage than is the first voltage.

11. The display device of claim 10, wherein the precharge voltage is a voltage between an eighth voltage and a seventh voltage when the difference between the maximum value and the representative value in the absolute values of the threshold voltages of the transistors included in the sample/hold circuits is a fifth voltage, the seventh voltage is a voltage which is further from the voltage of the first power source by an amount of the fifth voltage than is the fourth voltage, and the eighth voltage is a voltage which is closer to the voltage of the first power by an amount of the sixth voltage than is the second voltage.

12. The display device of claim 6, wherein the data storage element includes a transistor and a capacitor coupled between a gate and a source of the transistor of the data storage element, the sampling switch includes a first switch coupled between a drain of the transistor of the data storage element and an input terminal, a second switch for diode-connecting the transistor of the data storage element when turned on, and a third switch coupled between the first power and the transistor of the data storage element, and the holding switch includes a fourth switch coupled between a second power and the transistor of the data storage element and a fifth switch coupled between the transistor of the data storage element and an output terminal.

13. The display device of claim 2, wherein a same precharge voltage is applied to the plurality of sample/hold circuits.

14. The display device of claim 2, wherein different precharge voltages are applied to at least two of the plurality of sample/hold circuits when ranges of the first current applied to the at least two of the plurality of sample/hold circuits are different.

15. The display device of claim 1, wherein the display area further includes a plurality of second signal lines for supplying a power supply voltage to the pixel circuits; and the display device further includes a power line insulated from the first signal lines and crossing the first signal lines between the demultiplexer unit and the data driver, the power line for transmitting the power supply voltage from a corresponding one of the second signal lines.

16. The display device of claim 15, wherein the power supply voltage is supplied from the power line.

17. The display device of claim 15, wherein the data driver comprises the precharge unit.

18. The display device of claim 1, wherein the light emitting element utilizes electroluminescent emission of organic matter.

19. A display device comprising:

a display area including a plurality of first and second data lines extended in one direction and a plurality of pixel circuits coupled to the plurality of first and second data lines;

a plurality of first signal lines;

a first sample/hold circuit coupled between each of the plurality of first signal lines and a corresponding one of the first data lines for holding a first data current for displaying an image, to the corresponding one of the first data lines;

a second sample/hold circuit coupled between each of the plurality of first signal lines and a corresponding one of the second data lines for holding a second data current for displaying an image, to the corresponding one of the second data lines;

a data driver coupled to the plurality of first signal lines for sequentially transmitting a plurality of first and second currents respectively corresponding to the first and second data currents to the plurality of first signal lines; and a precharge unit coupled to the plurality of first signal lines for transmitting a first precharge voltage to the plurality of first signal lines before a corresponding first current is applied to each of the plurality of first signal lines, and transmitting a second precharge voltage to the plurality of first signal lines before a corresponding second current is applied to each of the plurality of first signal lines, wherein the first and second sample/hold circuits respectively sample the first and second currents during a portion of one horizontal period, and hold the first and second currents during a subsequent horizontal period, and wherein each of the pixel circuits includes a transistor to which a corresponding one of the plurality of first and second data currents flows from a corresponding one of the plurality of first and second data lines, a capacitor coupled between the source and the gate of the transistor and for storing a voltage corresponding to the current flowing to the transistor; and a light emitting element for emitting light corresponding to the current flowing to the transistor according to the voltage stored in the capacitor.

20. The display device of claim 19, wherein the first precharge voltage is substantially equal to the second precharge voltage.

21. The method of claim 19, wherein the first precharge voltage differs from the second precharge voltage when the range of the first current corresponding to one of the plurality of first data lines differs from the range of the second current corresponding to a corresponding one of the plurality of second data lines.

* * * * *